US008983334B2

(12) United States Patent
Hiramatsu et al.

(10) Patent No.: US 8,983,334 B2
(45) **Date of Patent: *Mar. 17, 2015**

(54) IMAGE FORMING APPARATUS HAVING A PATH REGULATING MEMBER

(71) Applicant: Canon Kabushiki Kaisha, Tokyo (JP)

(72) Inventors: Daisuke Hiramatsu, Numazu (JP); Takashi Akutsu, Odawara (JP); Tsutomu Nishiuwatoko, Numazu (JP); Ken Kikuchi, Mishima (JP); Kensuke Suzuki, Tagata-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/247,348

(22) Filed: Apr. 8, 2014

(65) Prior Publication Data

US 2014/0219678 A1 Aug. 7, 2014

Related U.S. Application Data

(63) Continuation of application No. 14/054,990, filed on Oct. 16, 2013, now Pat. No. 8,737,872, which is a continuation of application No. 13/554,570, filed on Jul. 20, 2012, now Pat. No. 8,666,278, which is a continuation of application No. PCT/JP2011/068720, filed on Aug. 12, 2011.

(30) Foreign Application Priority Data

Aug. 19, 2010 (JP) ..... 2010-183956

(51) Int. Cl.
*G03G 21/16* (2006.01)
*G03G 21/18* (2006.01)

(52) U.S. Cl.
CPC ..... *G03G 21/1671* (2013.01); *G03G 21/1604* (2013.01); *G03G 21/1633* (2013.01);

(Continued)

(58) Field of Classification Search
USPC ..... 399/110, 111, 112, 113, 125
See application file for complete search history.

(56) References Cited

U.S. PATENT DOCUMENTS 7,761,025 B2 7/2010 Sato
7,778,567 B2 8/2010 Igarashi et al.

(Continued)

FOREIGN PATENT DOCUMENTS

JP 10-026863 A 1/1998
JP 2001-066968 A 3/2001

(Continued)

OTHER PUBLICATIONS

International Search Report mailed Nov. 22, 2011, in International Application No. PCT/JP2011/068720.

(Continued)

*Primary Examiner* — Sophia S Chen
(74) *Attorney, Agent, or Firm* — Fitzpatrick, Cella, Harper & Scinto

(57) ABSTRACT

In an image forming apparatus including a door 10 openable with respect to a main assembly of the image forming apparatus, a drum cartridge 8 detachably mountable to the image forming apparatus main assembly, and detachably mountable developing cartridges 4*k*-4*y* provided above the drum cartridge 8, wherein the door 10 includes a positioning urging portion 26 contacting the developing cartridges in a state in which the door 10 is closed, the door 10 includes drum cartridge mounting and demounting guides 28R and 28L for regulating the drum cartridge 8 so as to pass along a non-interference path with the positioning urging portion 26 in contact to the drum cartridge 8 when the drum cartridge 8 is demounted from the image forming apparatus.

12 Claims, 26 Drawing Sheets

(52) U.S. Cl.
CPC .... *G03G21/1676* (2013.01); *G03G 2215/0697* (2013.01); *G03G 2221/1654* (2013.01); *G03G 2221/169* (2013.01); *G03G 2215/066* (2013.01)
USPC ..... 399/110; 399/112; 399/113

(56) References Cited

U.S. PATENT DOCUMENTS

| | | | | |
|---|---|---|---|---|
| 7,813,670 | B2 | 10/2010 | Matsuda | |
| 8,045,887 | B2 | 10/2011 | Sakashita et al. | |
| 8,185,013 | B2 | 5/2012 | Kikuchi et al. | |
| 8,213,825 | B2 | 7/2012 | Sato | |
| 8,737,872 | B2 * | 5/2014 | Hiramatsu et al. | 399/110 |
| 2006/0067734 | A1 | 3/2006 | Igarashi et al. | |
| 2007/0166070 | A1 | 7/2007 | Sato | |
| 2008/0028967 | A1 | 2/2008 | Sakashita et al. | |
| 2009/0190955 | A1 | 7/2009 | Igarashi et al. | |
| 2010/0239308 | A1 | 9/2010 | Kikuchi et al. | |
| 2010/0239312 | A1 | 9/2010 | Kikuchi et al. | |
| 2010/0247138 | A1 | 9/2010 | Kikuchi et al. | |
| 2010/0247140 | A1 | 9/2010 | Kikuchi et al. | |
| 2010/0247142 | A1 | 9/2010 | Kikuchi et al. | |
| 2011/0002709 | A1 | 1/2011 | Sato | |
| 2011/0305479 | A1 | 12/2011 | Nishiuwatoko et al. | |
| 2012/0003005 | A1 | 1/2012 | Nishiuwatoko | |
| 2012/0195627 | A1 | 8/2012 | Kikuchi | |
| 2012/0288304 | A1 | 11/2012 | Kikuchi et al. | |
| 2012/0294646 | A1 | 11/2012 | Suzuki et al. | |

FOREIGN PATENT DOCUMENTS

| | | | |
|---|---|---|---|
| JP | 2002-072826 | A | 3/2002 |
| JP | 2002-207408 | A | 7/2002 |
| JP | 2006-098772 | A | 4/2006 |
| JP | 2007-193125 | A | 8/2007 |
| JP | 2007-333817 | A | 12/2007 |

OTHER PUBLICATIONS

Kensuke Suzuki et al., U.S. Appl. No. 13/472,808, filed May 16, 2012.

* cited by examiner (a)

(b)

(a)

(b)

(a)

(b)

(a)

(b)

(a)

(b)

IMAGE FORMING APPARATUS HAVING A PATH REGULATING MEMBER

This application is a continuation of application Ser. No. 14/054,990, filed Oct. 16, 2013, which is a continuation of application Ser. No. 13/554,570, filed Jul. 20, 2012, now U.S. Pat. No. 8,666,278, issued Mar. 4, 2014, which is a continuation of International Application No. PCT/JP2011/068720, filed Aug. 12, 2011.

TECHNICAL FIELD

The present invention relates to an image forming apparatus such as a copying machine or a facsimile machine.

BACKGROUND ART

Heretofore, there has been an image forming apparatus of a process cartridge type in which a cartridge such as a drum cartridge provided with a photosensitive drum or a developing cartridge provided with a developing roller. For example, in U.S. Pat. No. 7,813,670, a door provided to an apparatus main assembly is opened and then the cartridge can be demounted. Further, the door is provided with a positioning urging portion for urging the cartridge in a closed state to position the cartridge in the apparatus main assembly. Such an image forming apparatus is capable of individually replacing (exchanging) the photosensitive drum and the developing roller and therefore is effective in such a case where a product lifetime is different between the photosensitive drum and the developing roller.

However, with downsizing of the image forming apparatus in recent years, there arises a need to suppress a height of the apparatus main assembly or a size of the image forming apparatus with respect to a widthwise direction. With the need, a path along which the cartridge is demounted from the apparatus main assembly is being narrowed.

In the U.S. Pat. No. 7,813,670, the cartridge demounting path become narrow with the downsizing of the apparatus, so that when the cartridge was demounted, the cartridge contacted the positioning urging portion of the door and thus there was a possibility that damage or breakage of the positioning urging portion was caused.

DISCLOSURE OF THE INVENTION

In an embodiment of the present invention, there is provided an image forming apparatus comprising: a main assembly of the image forming apparatus; a door openable with respect to the a main assembly of the image forming apparatus; a first cartridge detachably mountable to the main assembly of the image forming apparatus in a state in which the door is open; and a detachably mountable second cartridge provided above the first cartridge, wherein the door includes a contact portion contactable to the second cartridge in a state in which the door is closed, and wherein the door includes a mounting and demounting path regulating member for regulating the first cartridge so that the first cartridge passes along a non-interference path with the contact portion by being contacted to the first cartridge when the first cartridge is demounted from the image forming apparatus.

BRIEF DESCRIPTION OF THE DRAWINGS

Part (a) of FIG. 1 is a perspective view of an image forming apparatus according to First Embodiment. Part (b) of FIG. 1 is an illustration of the image forming apparatus according to First Embodiment.

Figure 4:
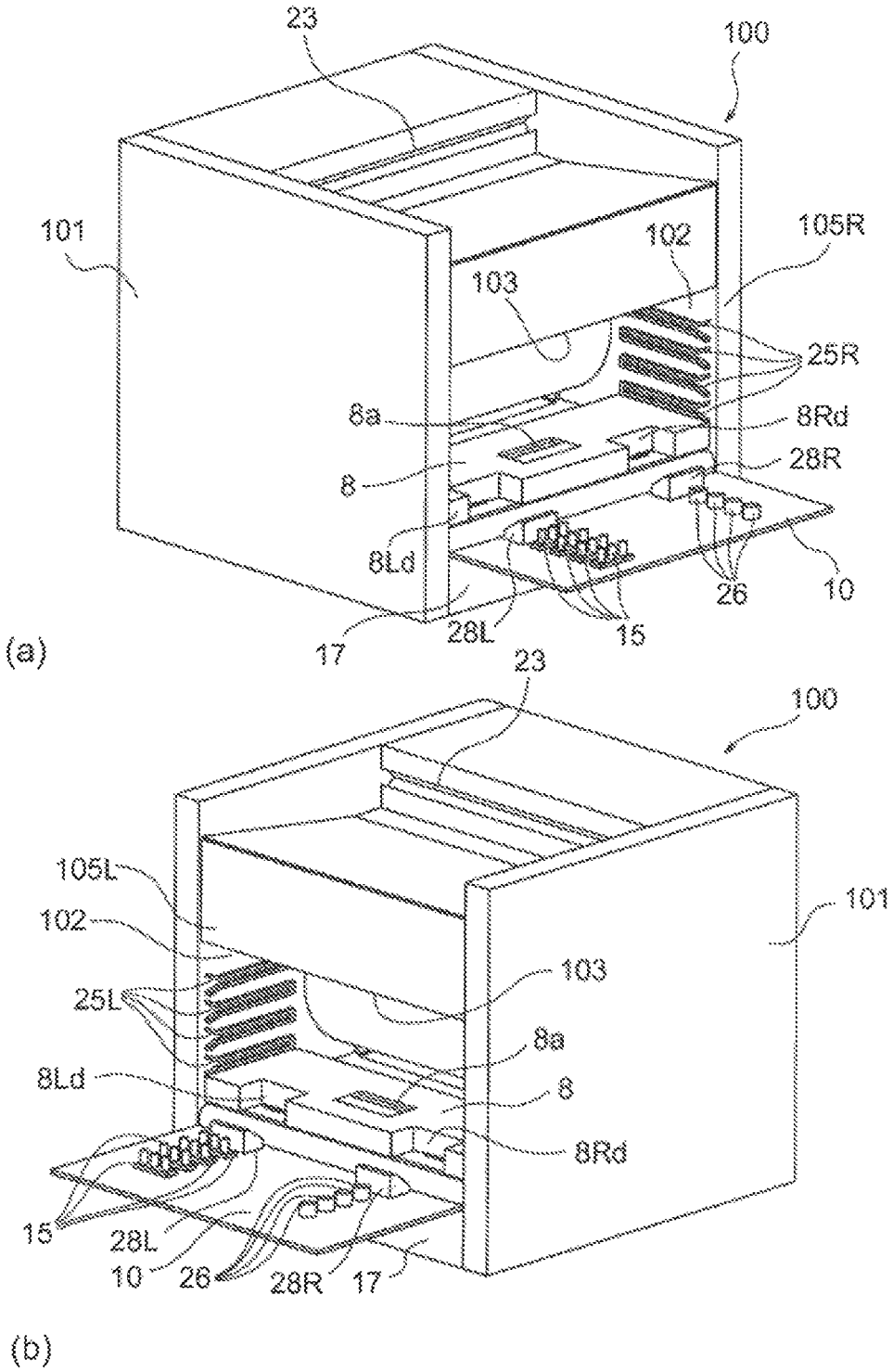

Parts (a) and (b) of FIG. 4 include perspective views of the image forming apparatus in a state in which the developing cartridges according to First Embodiment are demounted.

Figure 5:
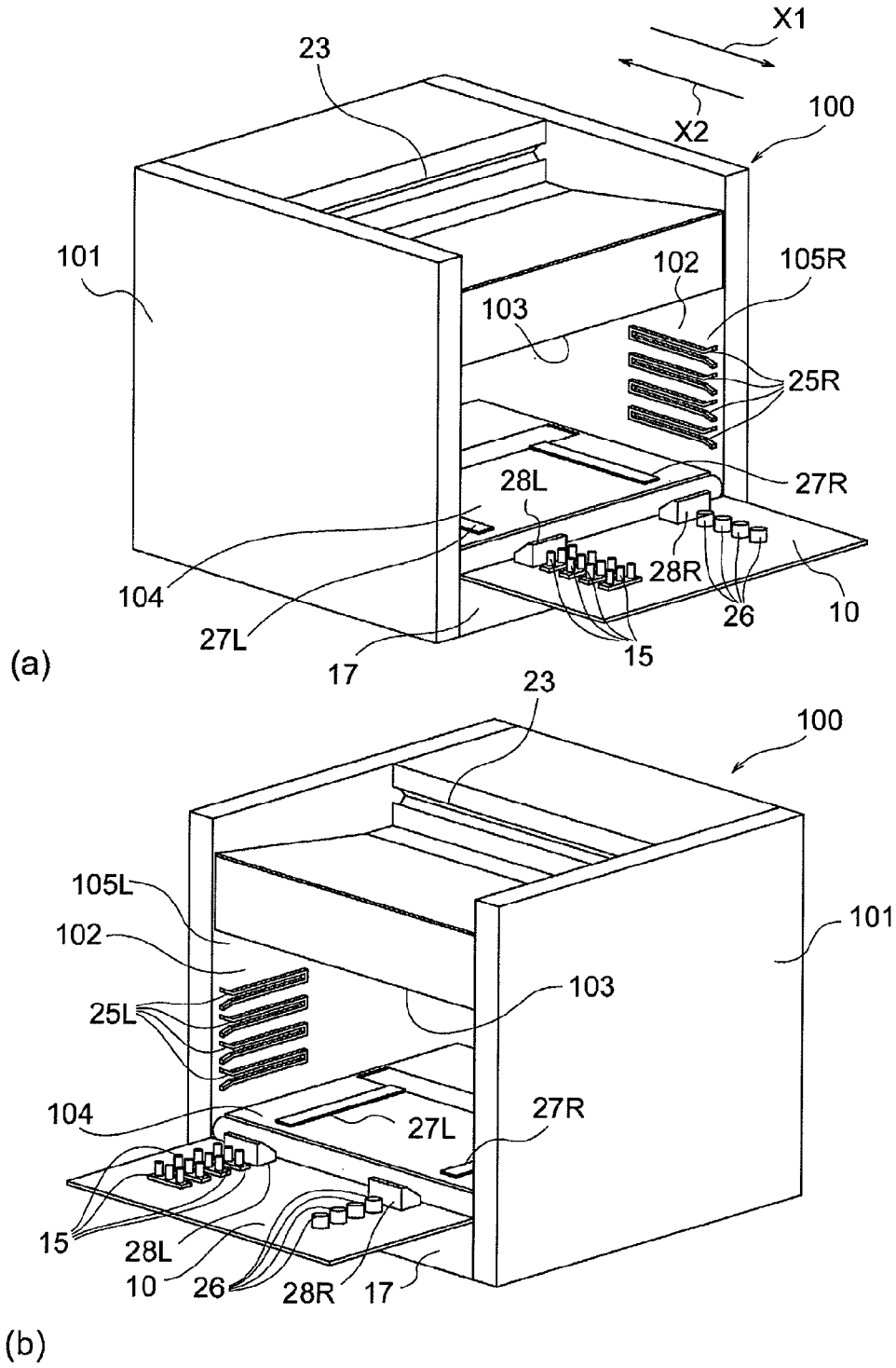

Parts (a) and (b) of FIG. 5 include perspective views of the image forming apparatus in a state in which a cartridge according to First Embodiment is demounted.

Figure 6:
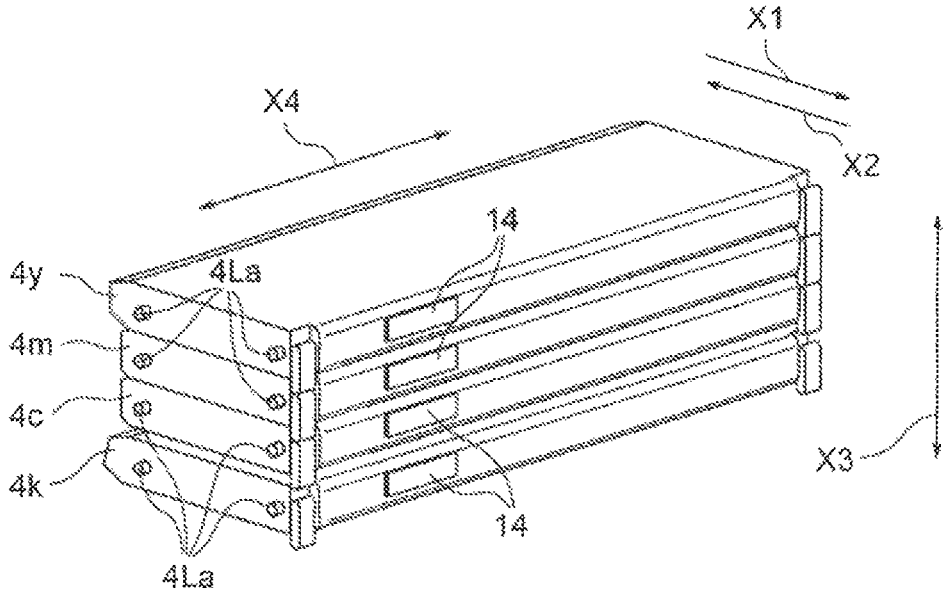
Figure 6:
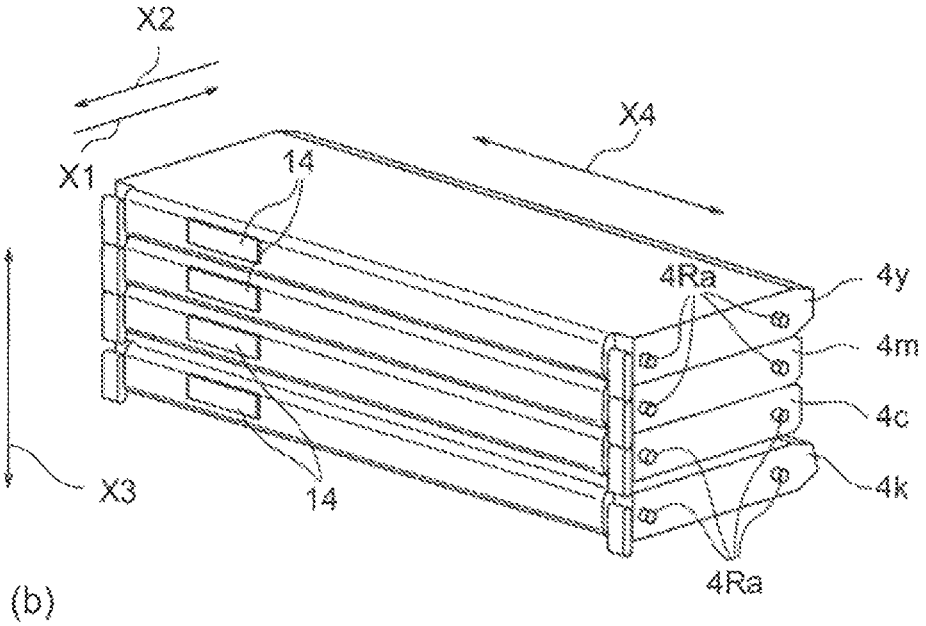

Parts (a) and (b) of FIG. 6 include perspective views of the developing cartridges according to First Embodiment.

Figure 7:
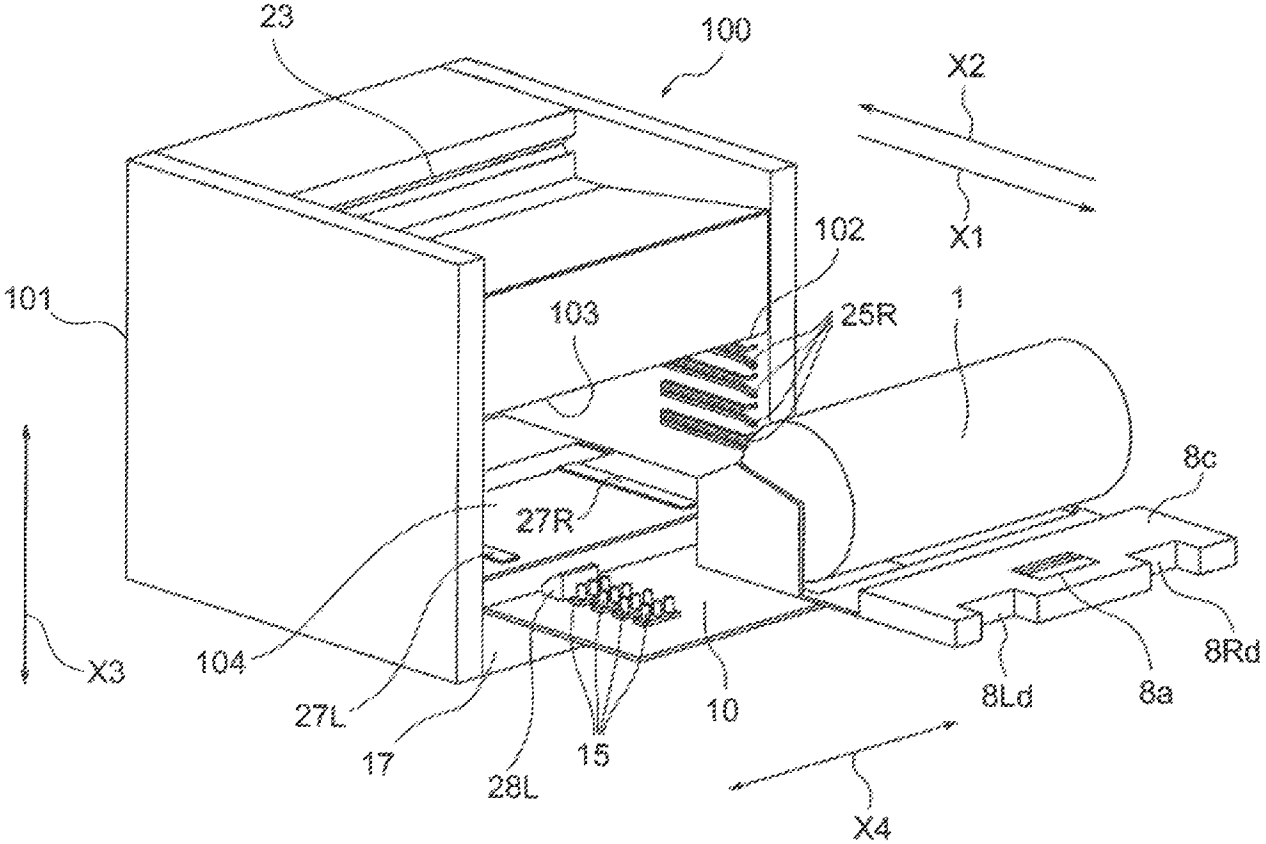

FIG. 7 is a view for illustrating mounting and demounting of a drum cartridge according to First Embodiment.

Figure 8:
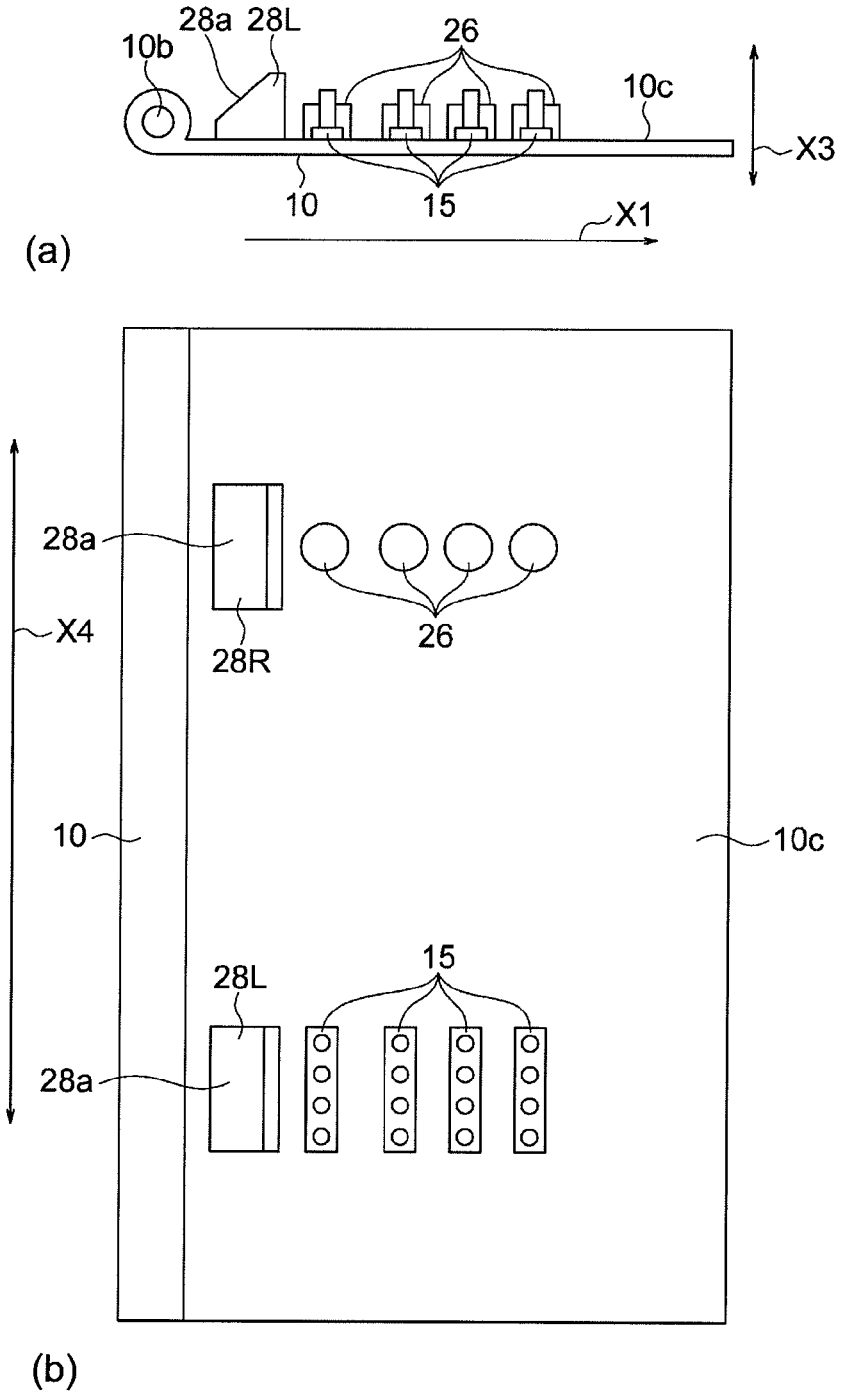

Part (a) of FIG. 8 is a left side view of the door according to First Embodiment. Part (b) of FIG. 8 is a top plan view of the door according to First Embodiment.

Figure 9:
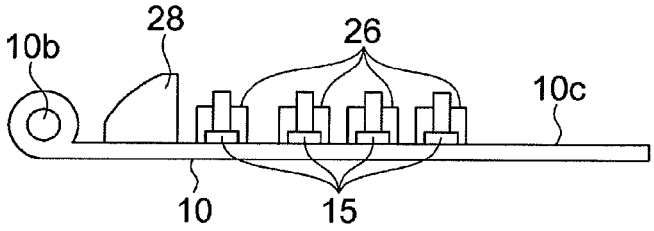

FIG. 9 is a left side view of the door provided with a mounting and demounting path regulating member in another shape.

Figure 10:
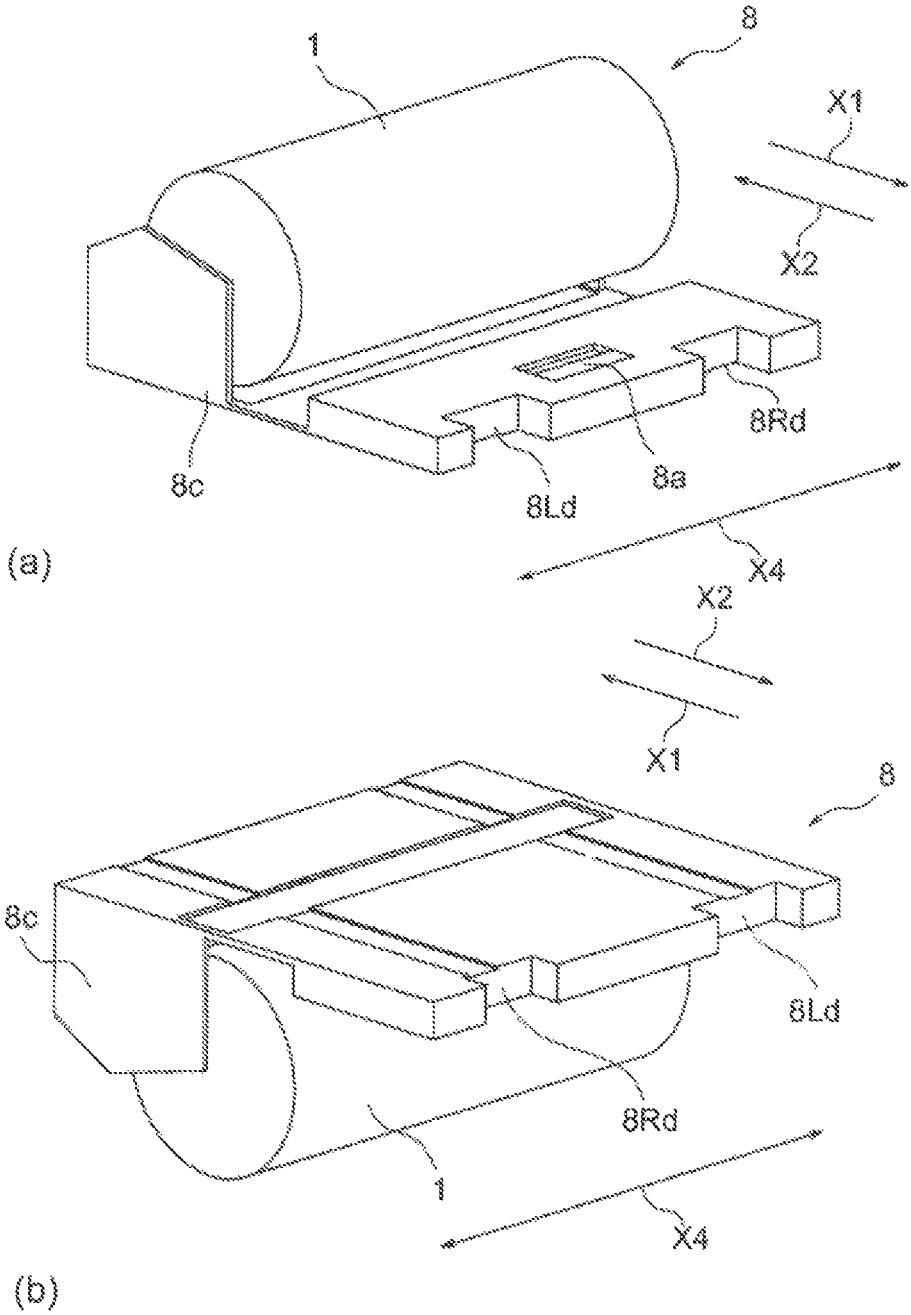

Parts (a) and (b) of FIG. 10 include perspective views of the drum cartridge according to First Embodiment.

Figure 11:
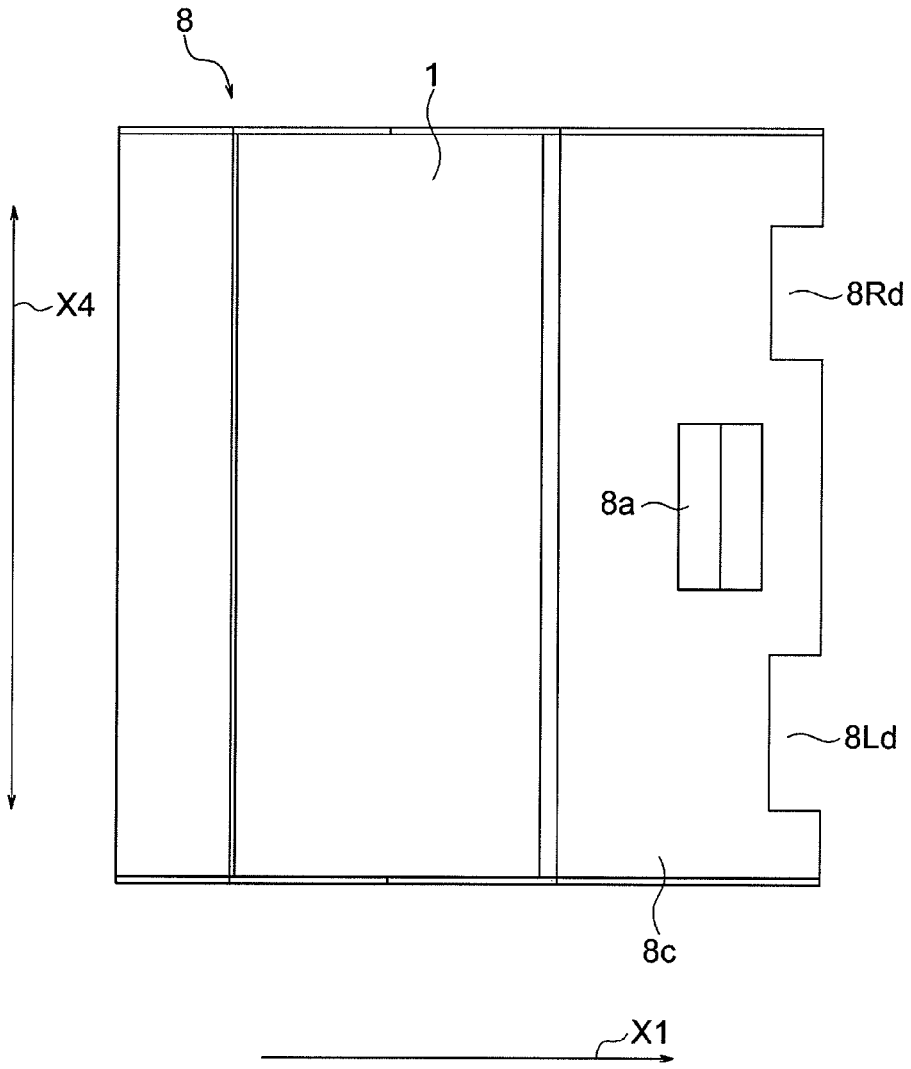

FIG. 11 is a top plan view of a clearance portion of the drum cartridge according to First Embodiment.

Figure 12:
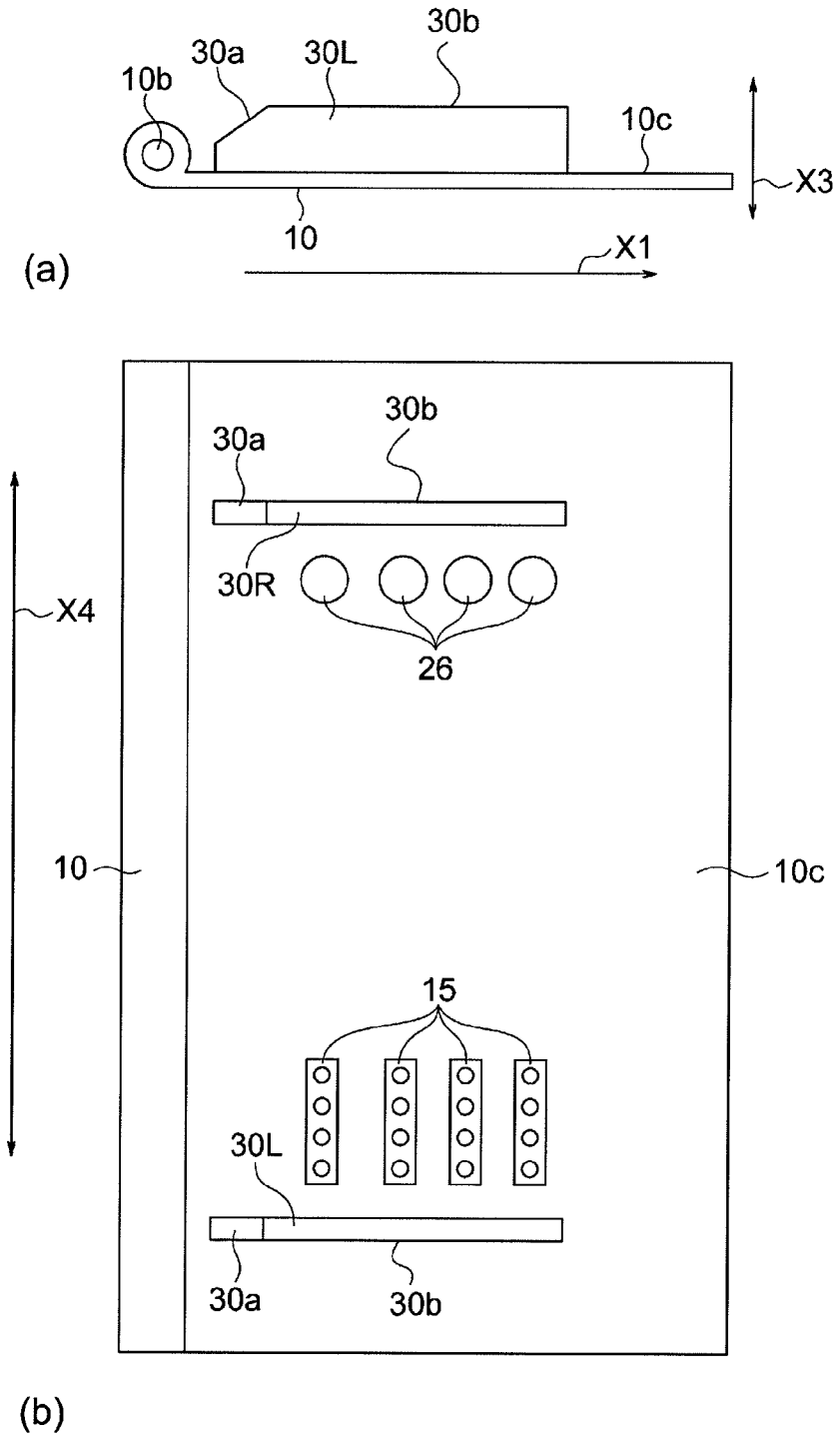

Part (a) of FIG. 12 is a left side view of a door according to Second Embodiment. Part (b) of FIG. 12 is a top plan view of the door according to Second Embodiment.

Figure 13:
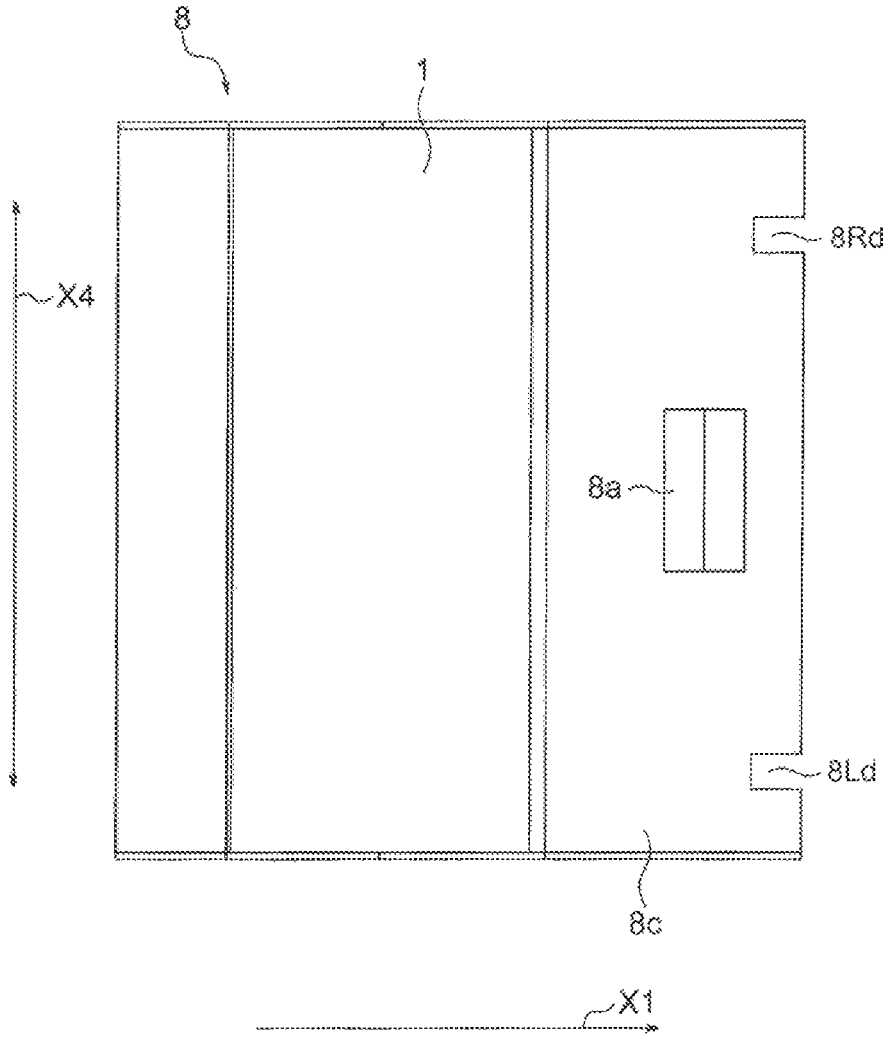

FIG. 13 is a top plan view of a drum cartridge according to Second Embodiment.

Figure 14:
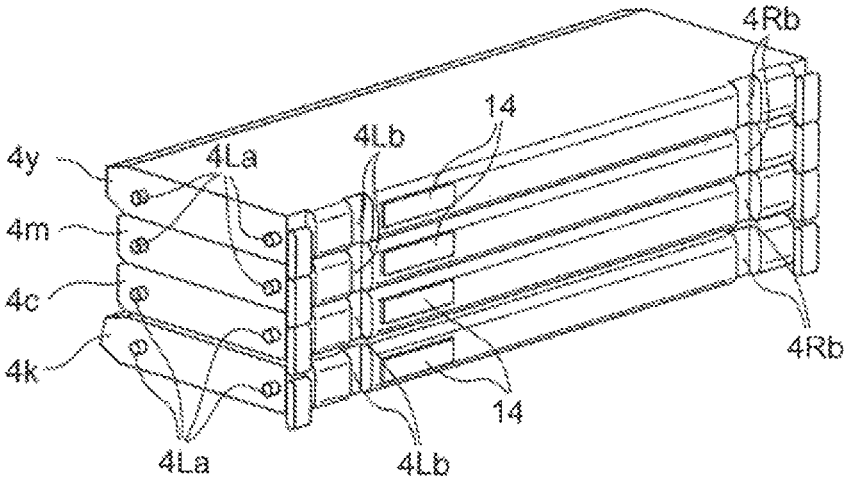
Figure 14:
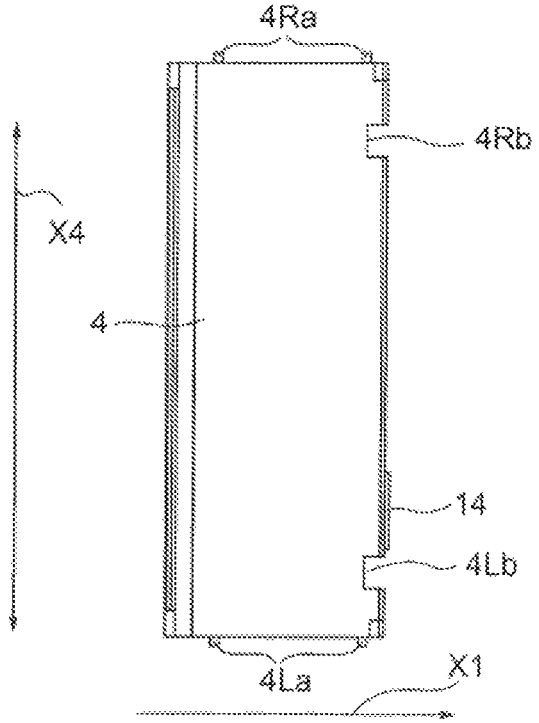

Part (a) of FIG. 14 is a perspective view of developing cartridges according to Second Embodiment. Part (b) of FIG. 14 is a top plan view of the developing cartridges according to Second Embodiment.

Figure 15:
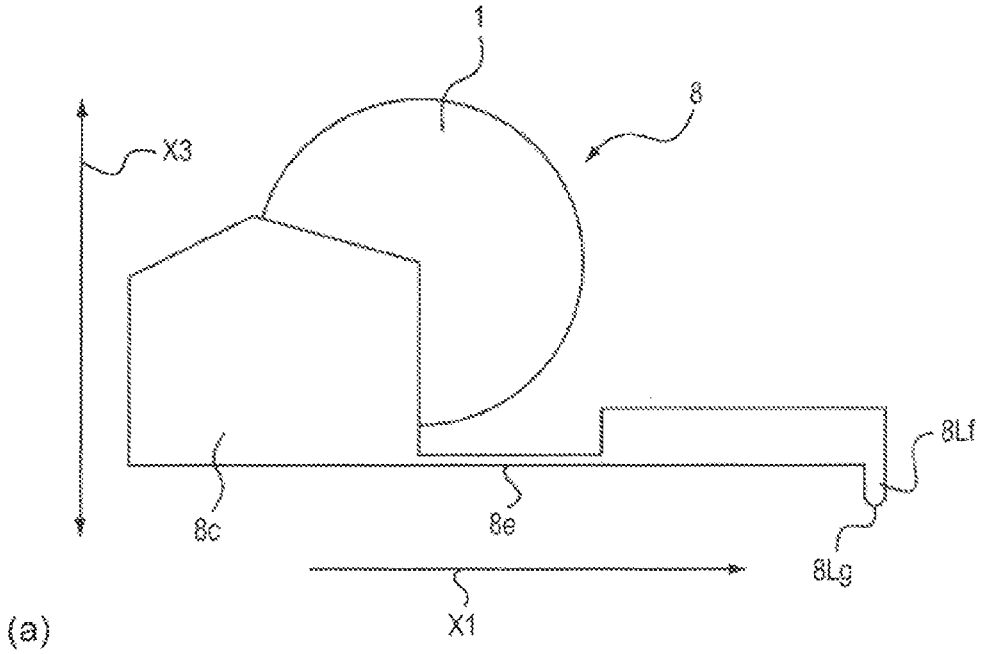
Figure 15:
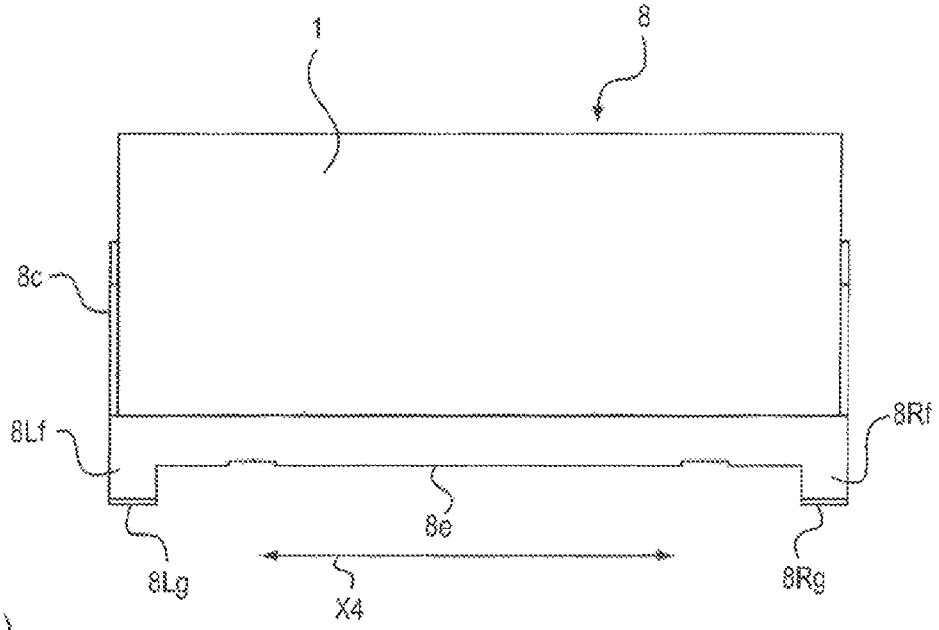

Part (a) of FIG. 15 is a left side view of a drum cartridge according to Third Embodiment. Part (b) of FIG. 15 is a front view of the drum cartridge according to Third Embodiment.

Figure 16:
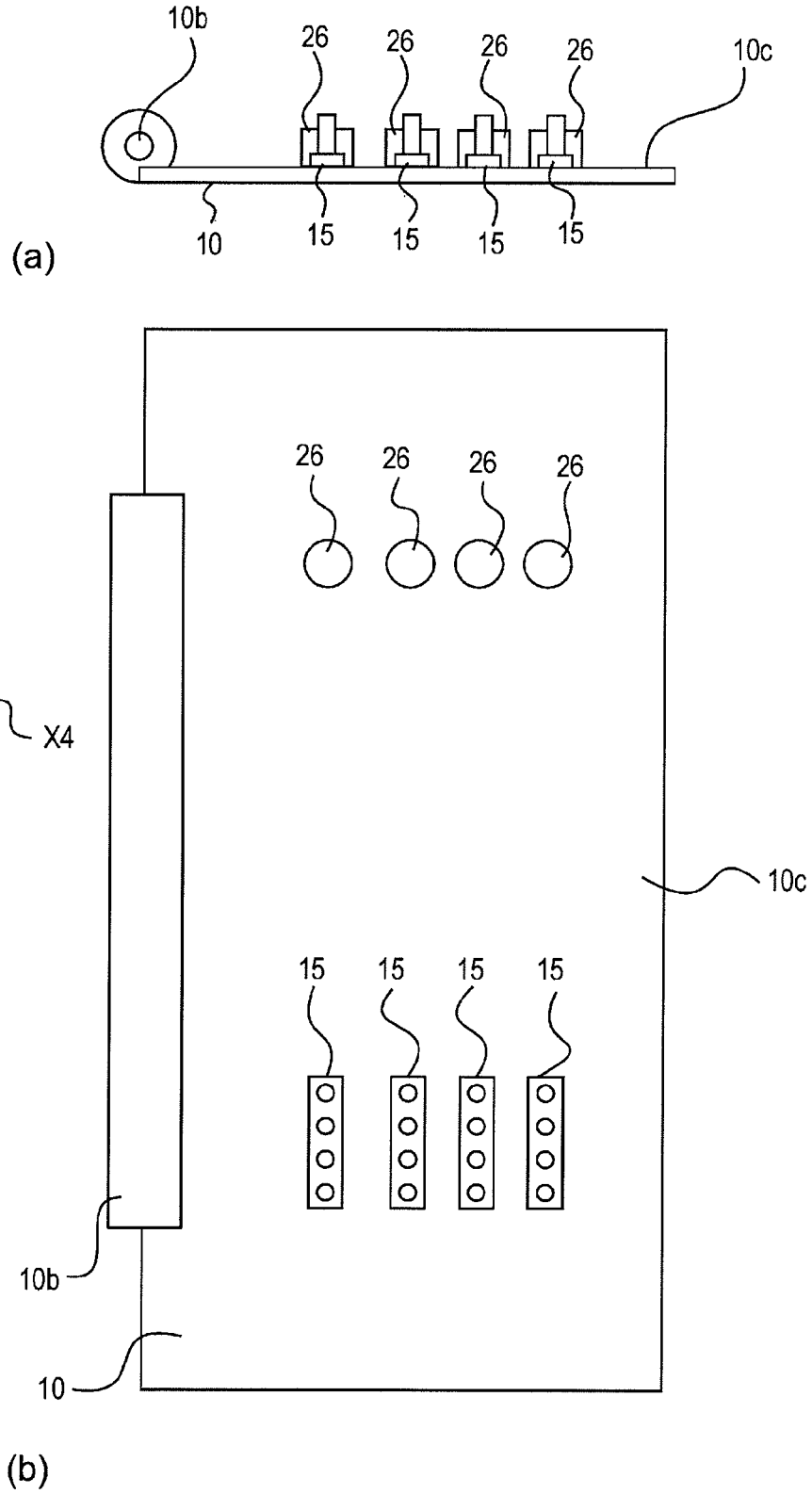

Part (a) of FIG. 16 is a left side view of a door according to Third Embodiment. Part (b) of FIG. 16 is a top plan view of the door according to Third Embodiment.

Figure 17:
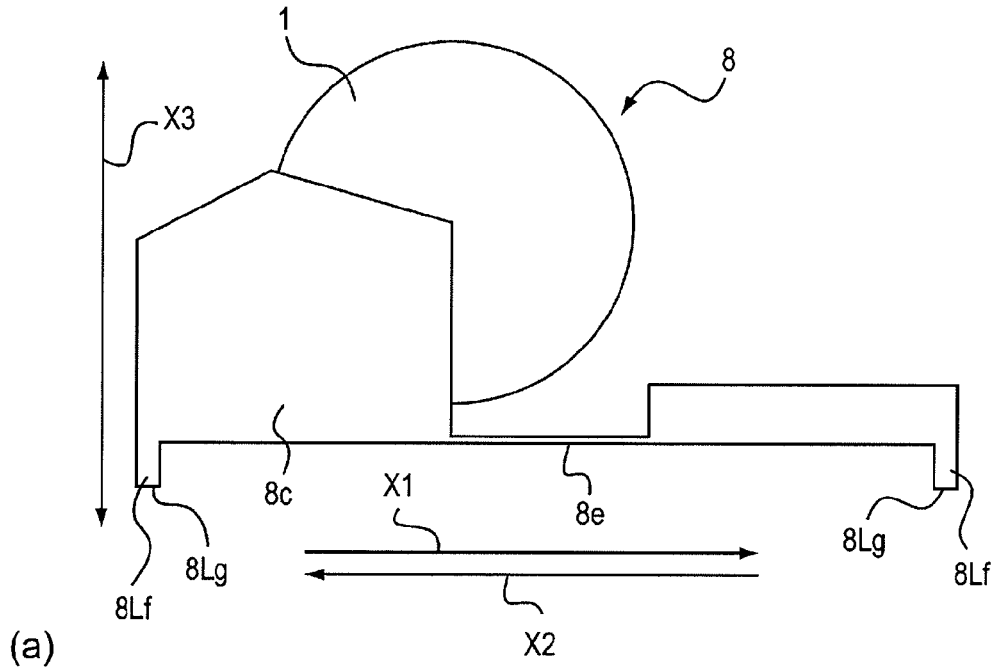
Figure 17:
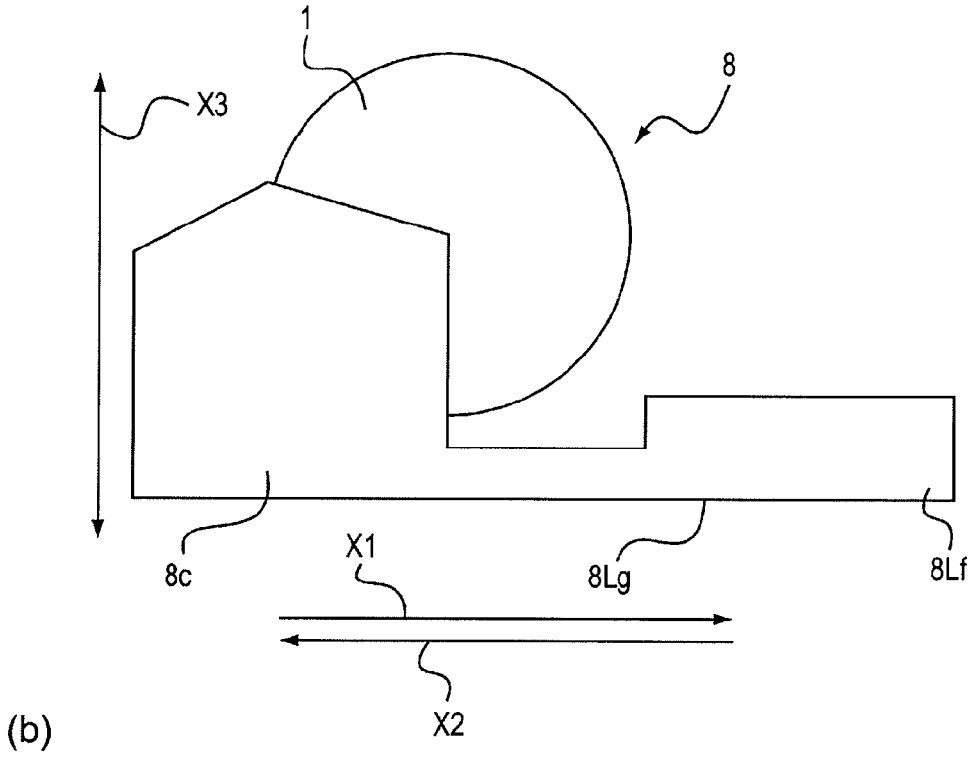

Parts (a) and (b) of FIG. 17 are left side views each showing an embodiment of the drum cartridge according to Third Embodiment.

Figure 18:
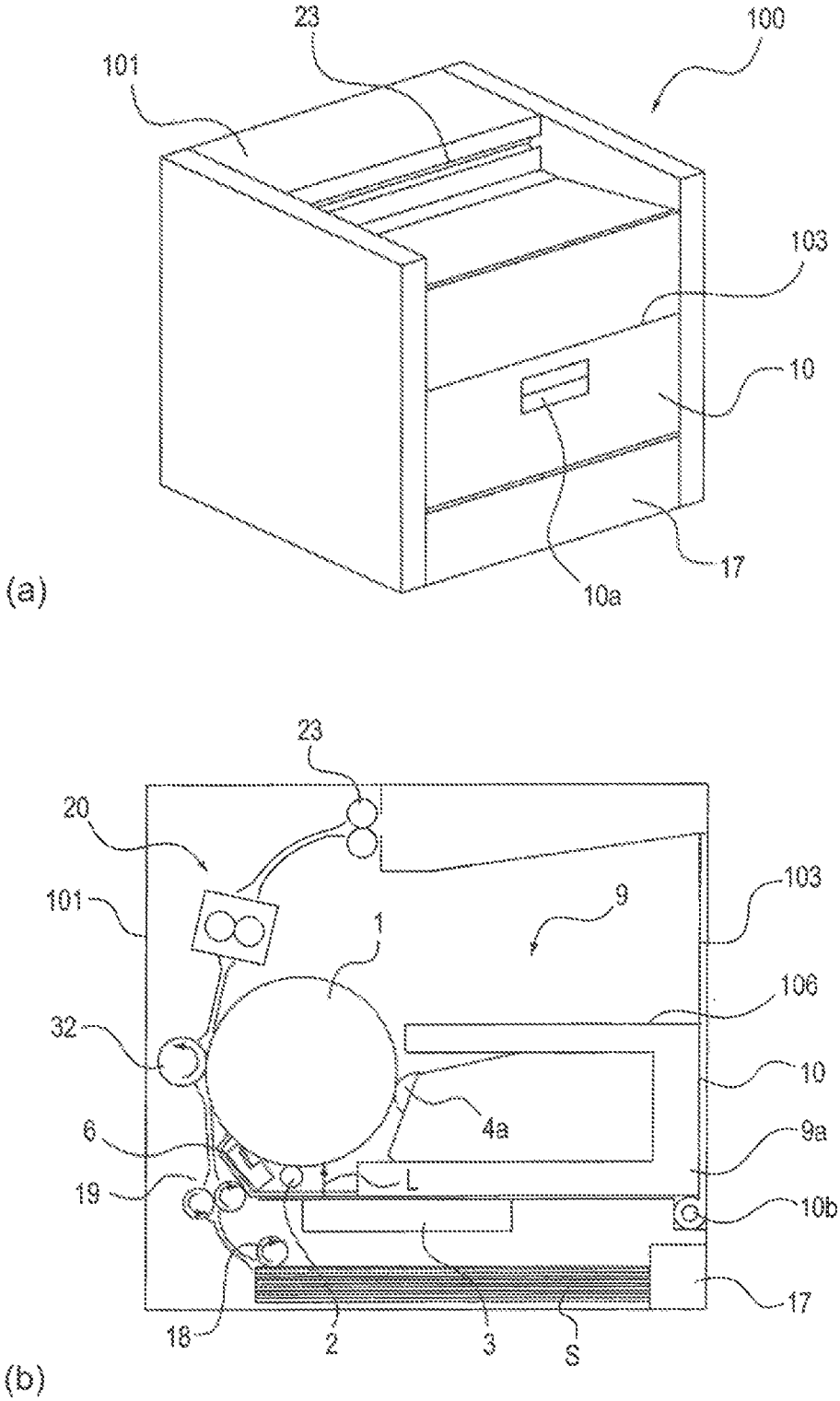

Part (a) of FIG. 18 is a perspective view of an image forming apparatus according to Fourth Embodiment. Part (b) of FIG. 18 is an illustration of the image forming apparatus according to Fourth Embodiment.

Figure 19:
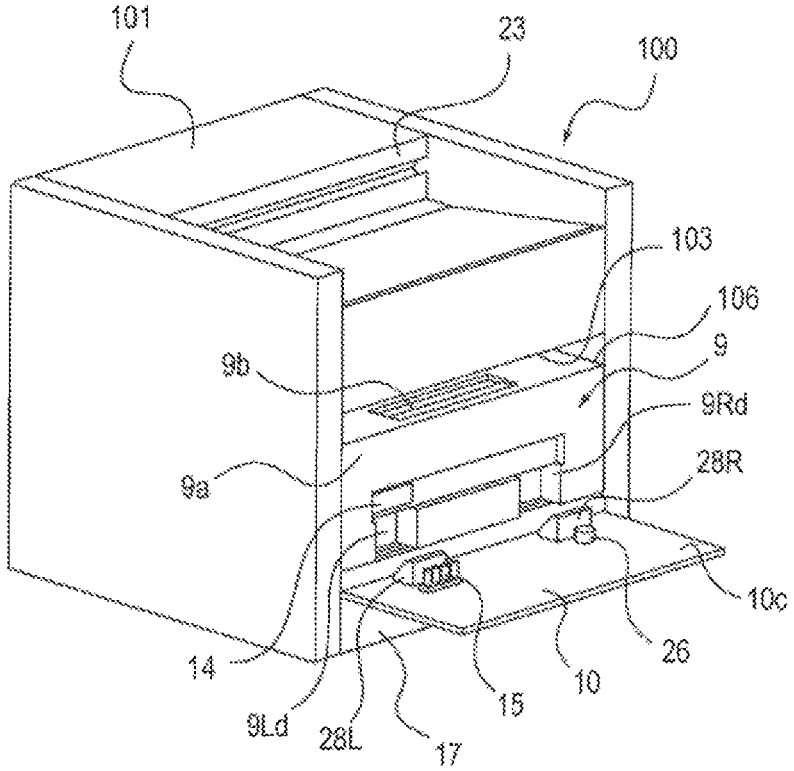

FIG. 19 is a perspective view of the image forming apparatus according to Fourth Embodiment in a state in which a door is open.

Figure 20:
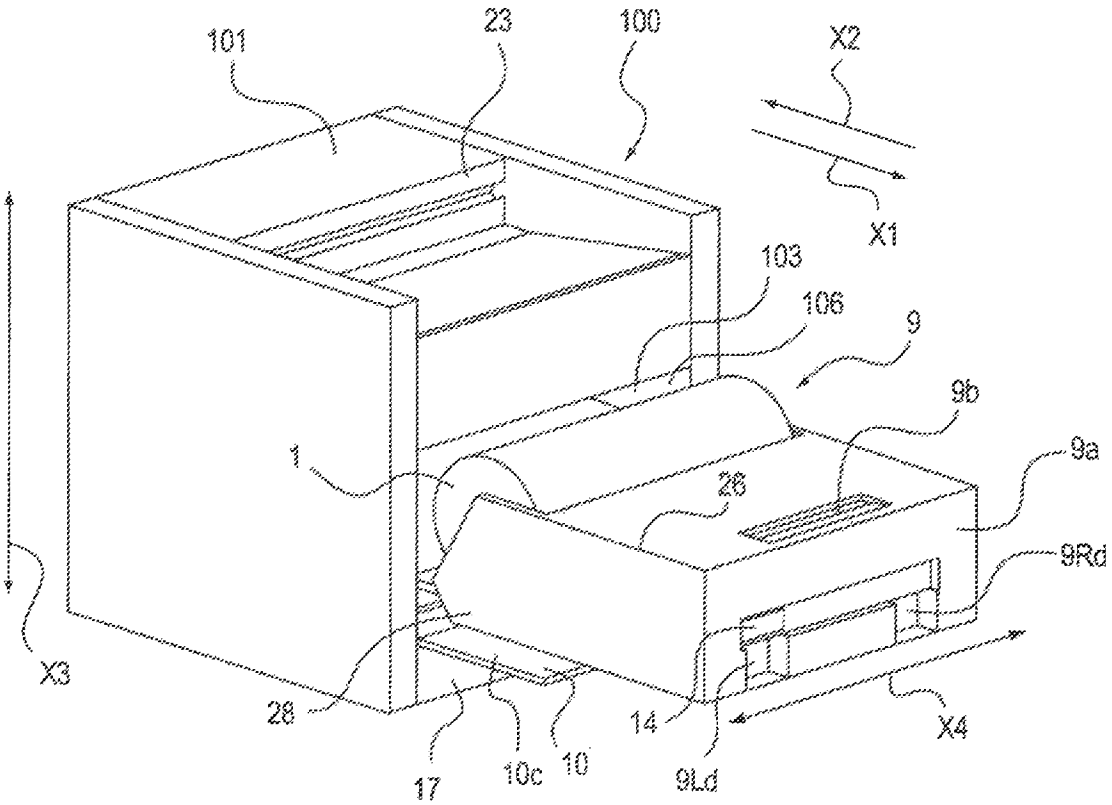

FIG. 20 is a view for illustrating mounting and demounting of an all-in-one cartridge according to Fourth Embodiment.

Figure 21:
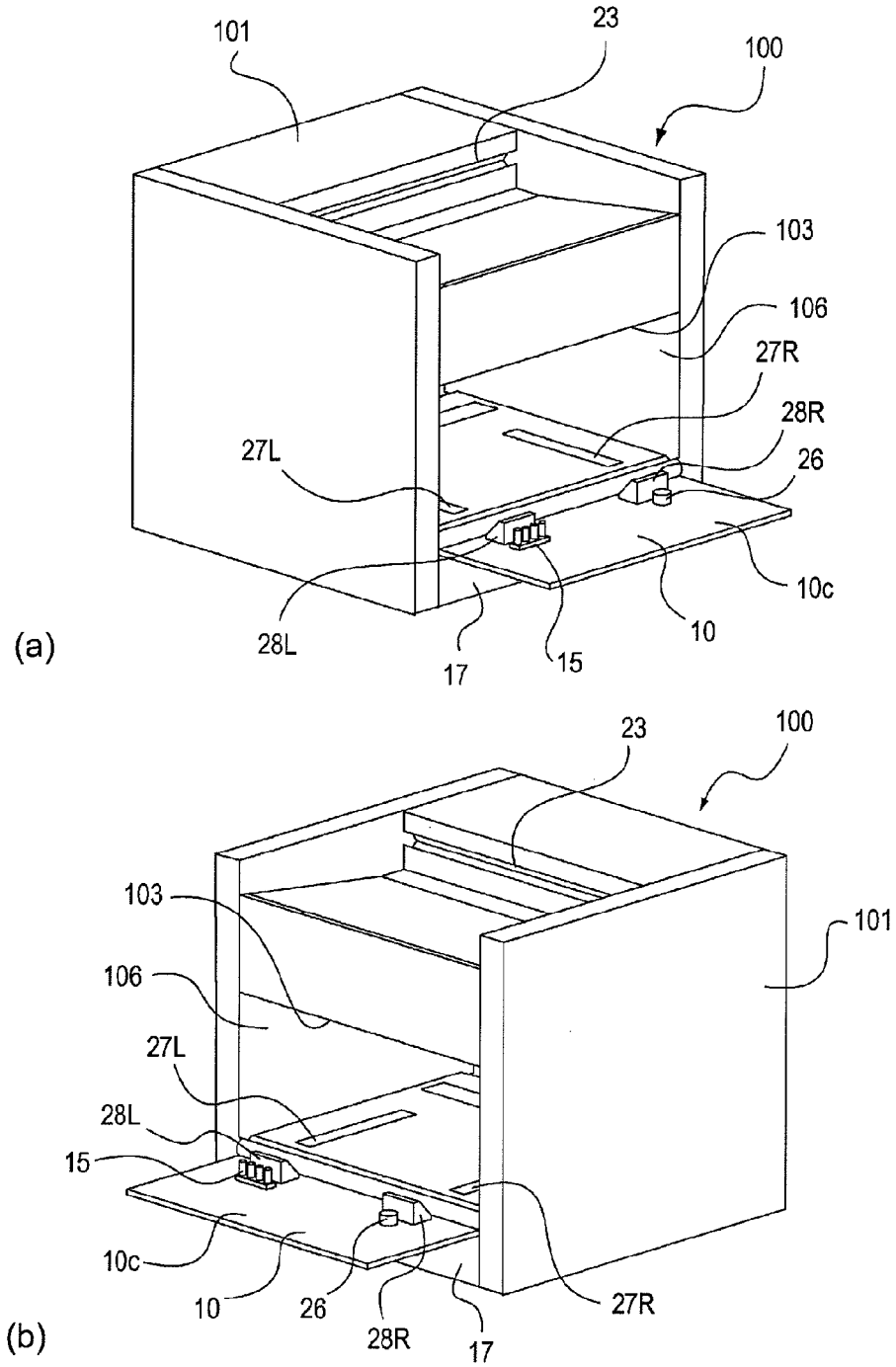

FIG. 21 includes perspective views of the image forming apparatus according to Fourth Embodiment in a state in which the all-in-one cartridge is demounted.

Figure 22:
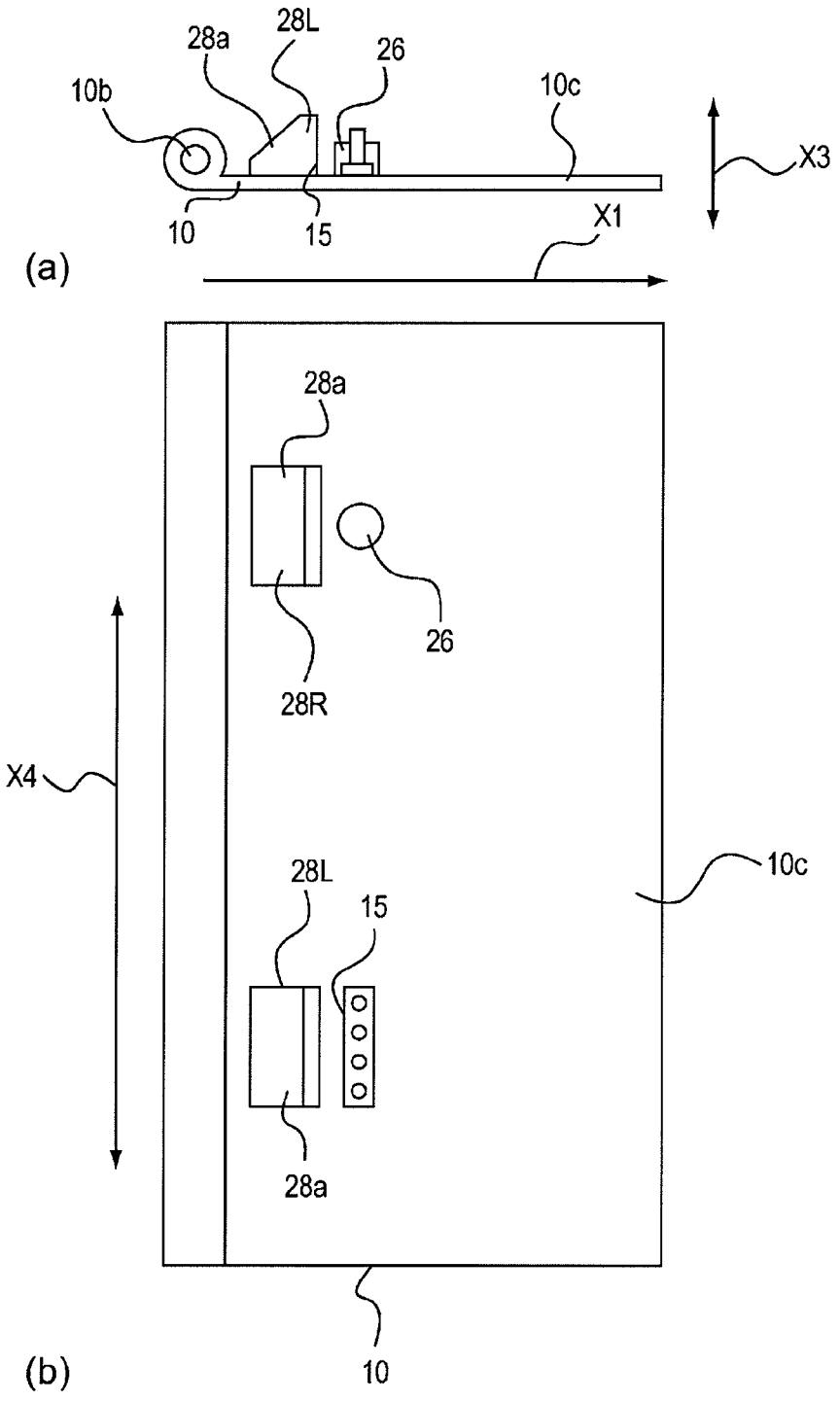

Part (a) of FIG. 22 is a left side view of the door according to Fourth Embodiment. Part (b) of FIG. 22 is a top plan view of the door according to Fourth Embodiment.

Figure 23:
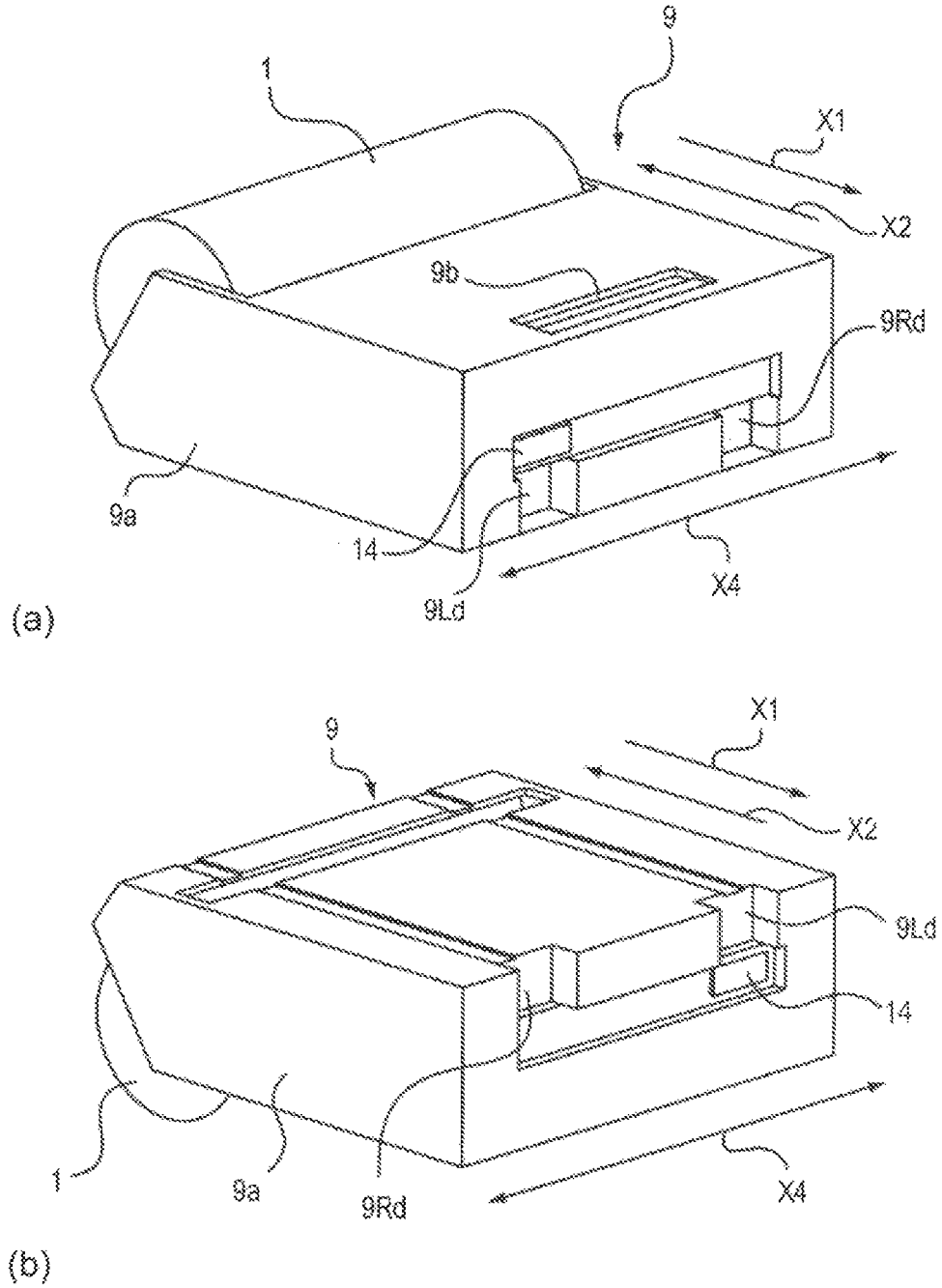

FIG. 23 includes perspective views of the all-in-one cartridge according to Fourth Embodiment.

Figure 24:
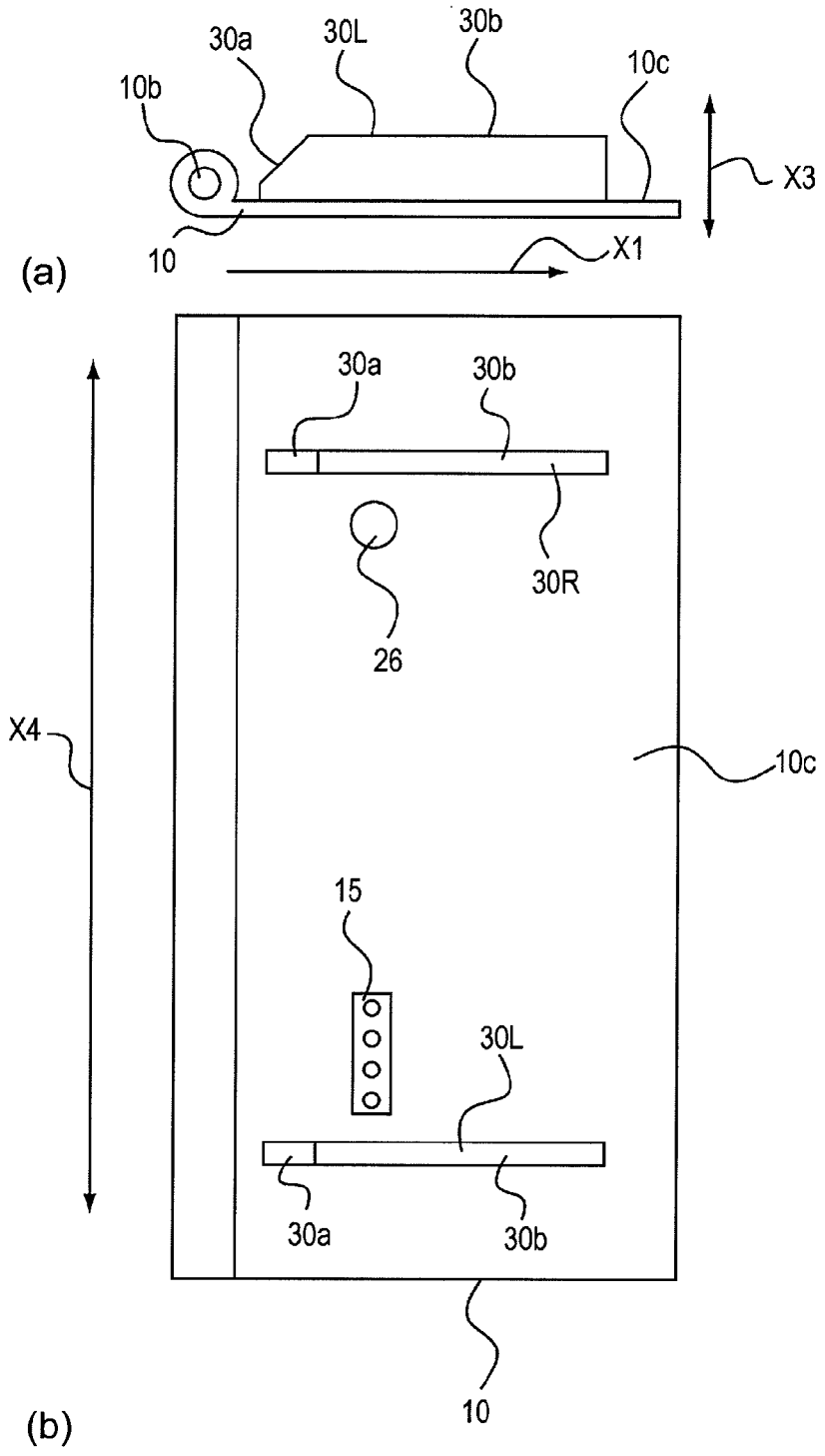

Part (a) of FIG. 24 is a left side view of a door according to Fifth Embodiment. Part (b) of FIG. 24 is a top plan view of the door according to Fifth Embodiment.

Figure 25:
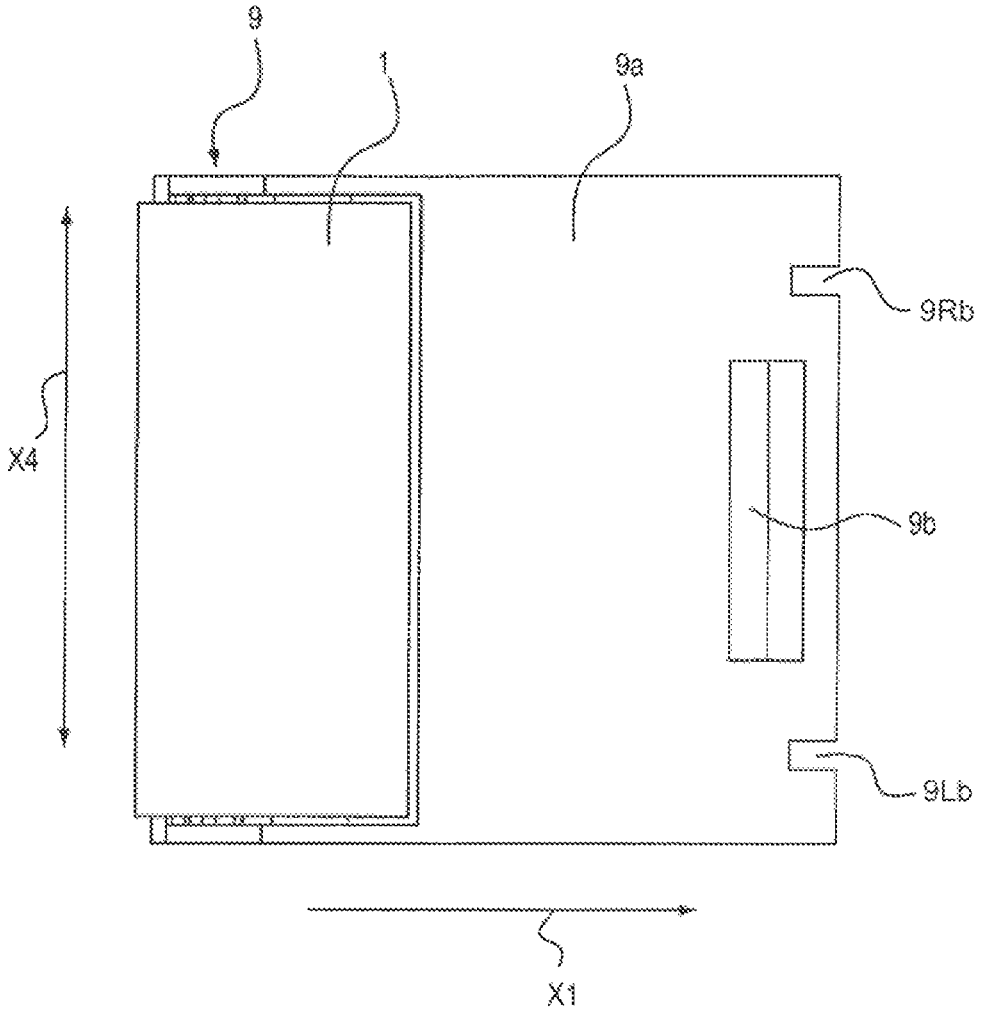

FIG. 25 is a top plan view of an all-in-one cartridge according to Fifth Embodiment.

Figure 26:
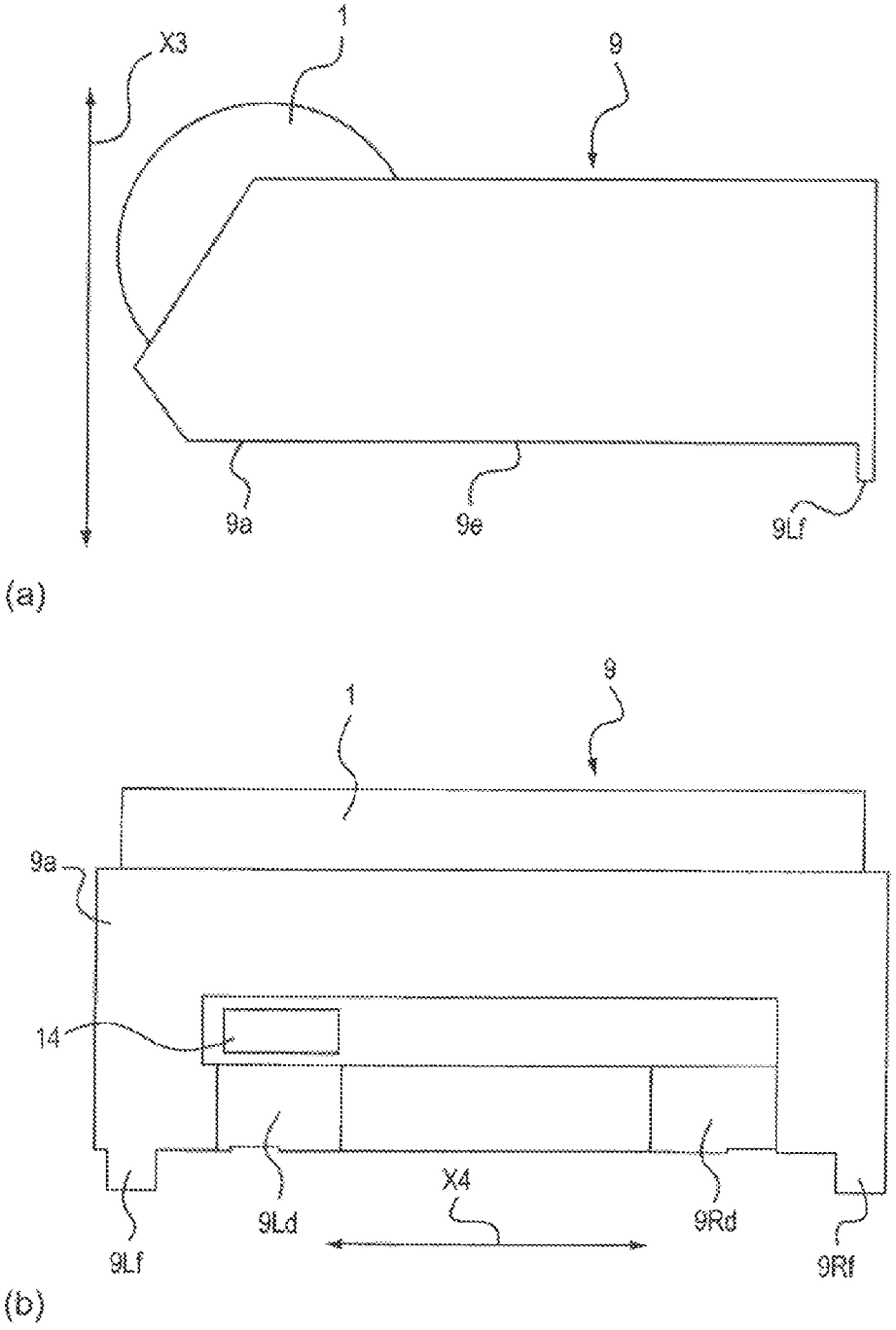

Part (a) of FIG. 26 is a left side view of an all-in-one cartridge according to Sixth Embodiment. Part (b) of FIG. 26 is a front view of the all-in-one cartridge according to Sixth Embodiment.

BEST MODE FOR CARRYING OUT THE INVENTION

First Embodiment

First Embodiment of an image forming apparatus according to the present invention will be described with reference to the drawings.

(Brief Description of Image Forming Apparatus 100)

Figure 1:
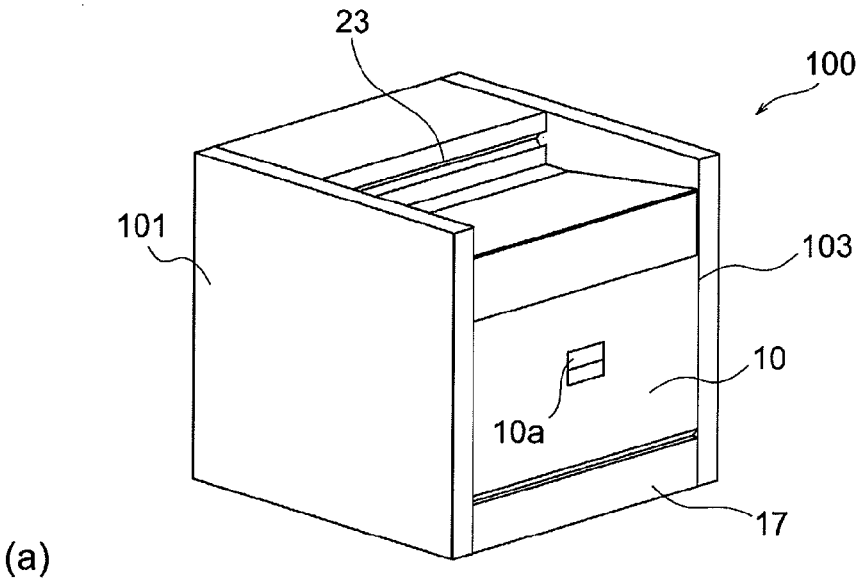
Figure 1:
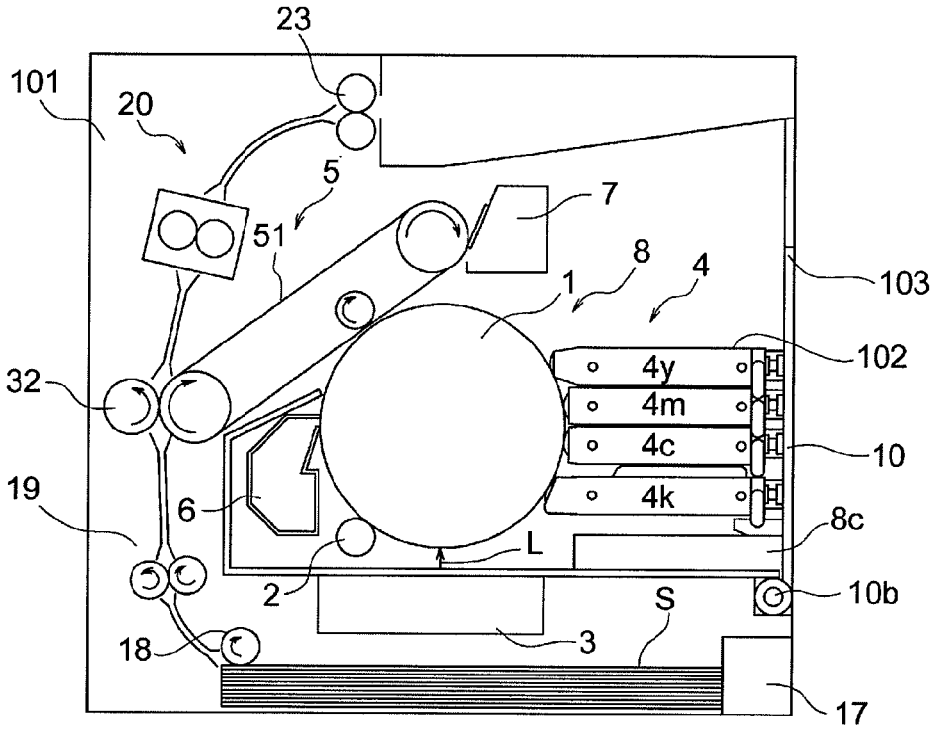

Part (a) of FIG. 1 is a perspective view of the image forming apparatus according to this embodiment. Part (b) of FIG. 1 is an illustration of the image forming apparatus according to this embodiment.

Figure 3:
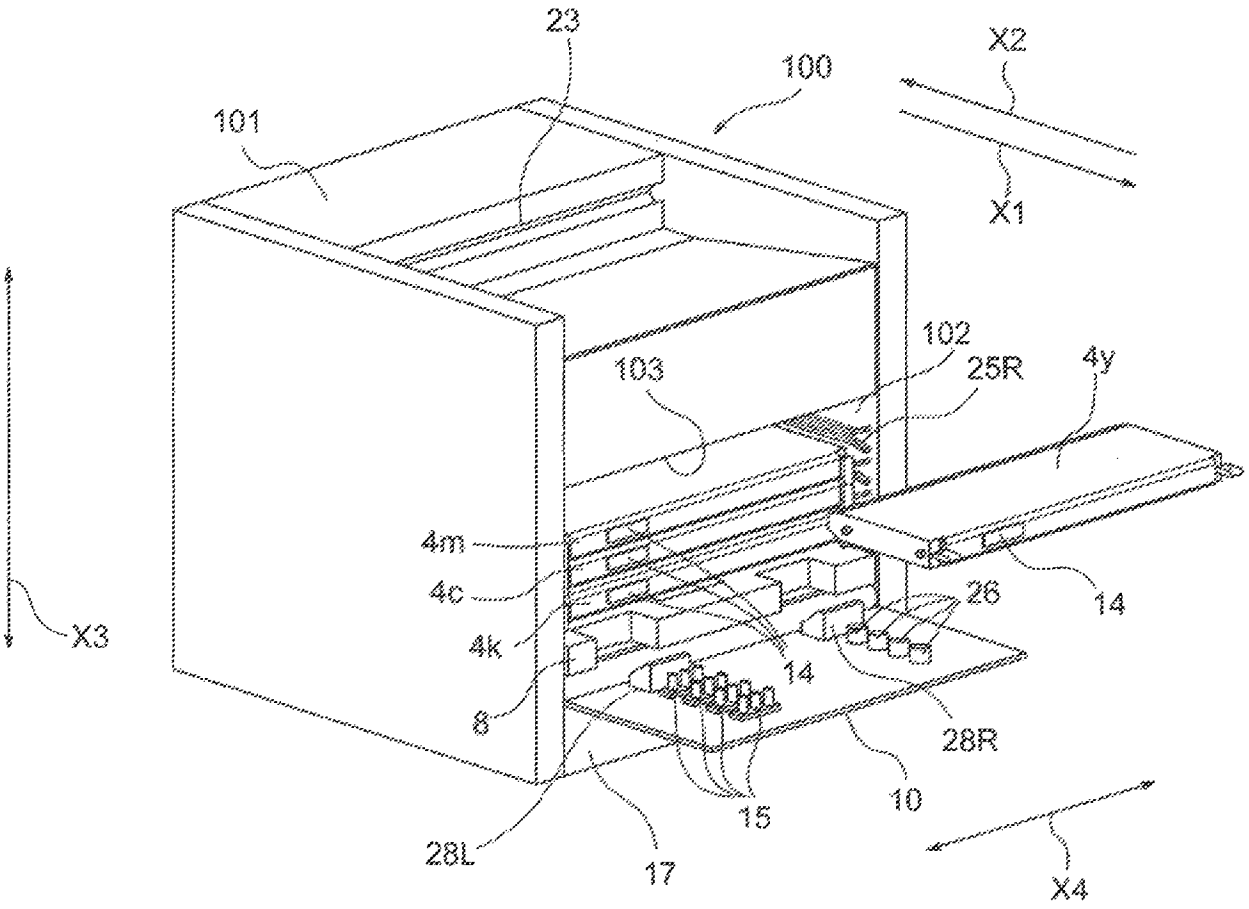
FIG. 3 is a view for illustrating mounting and demounting of a developing cartridge according to First Embodiment.

As shown in FIG. 1, the image forming apparatus 100 in this embodiment includes developing cartridges (second cartridge) 4*y*, 4*m*, 4*c* and 4*k* and a drum cartridge (first cartridge) 8. As shown in FIG. 3, the developing cartridges 4*y*-4*k* are detachably mounted to a developing cartridge mounting and demounting portion 102 of an image forming apparatus main assembly 101 in a state in which a door 10 is open. As shown in FIG. 4, the drum cartridge 8 is, after the developing cartridges 4*y*-4*k* are demounted in the state in which the portion 10 is open, detachably mounted to a drum cartridge mounting and demounting portion 104 (see (a) of FIG. 5).

The drum cartridge 8 includes a photosensitive drum (photosensitive member) 1. The photosensitive drum 1 is electrically charged by a charger 2 at its drum surface and is exposed to laser light L on the basis of image information by an exposure device 3, so that an electrostatic latent image is formed. The electrostatic latent image is developed, with toner of each of colors of yellow, magenta, cyan and black, as a toner image of each color by the developing cartridges 4*y*-4*k*. The developed toner image is primary-transferred onto an intermediary transfer belt 51 of an intermediary transfer unit 5. The transfer residual toner remaining on the photosensitive drum 1 after the primary transfer is cleaned (removed) by a drum cleaning device 6.

On the other hand, a sheet S stacked in a feeding cassette 17 is conveyed to a nip between a secondary transfer roller 32 and the intermediary transfer belt 51 by a feeding roller 18 and a registration roller pair 19, so that the toner image primary-transferred on the intermediary transfer belt 51 is secondary-transferred. The sheet S on which the toner image is transferred is subjected to fixing of the toner image by a fixing portion 20 and is discharged to the outside of the apparatus main assembly by a discharging roller pair 23. A transfer residual toner remaining on the intermediary transfer belt 51 is cleaned (removed) by a belt cleaning device 7.

(Exchange Type of Developing Cartridges 4*y*-4*k*)

Figure 2:
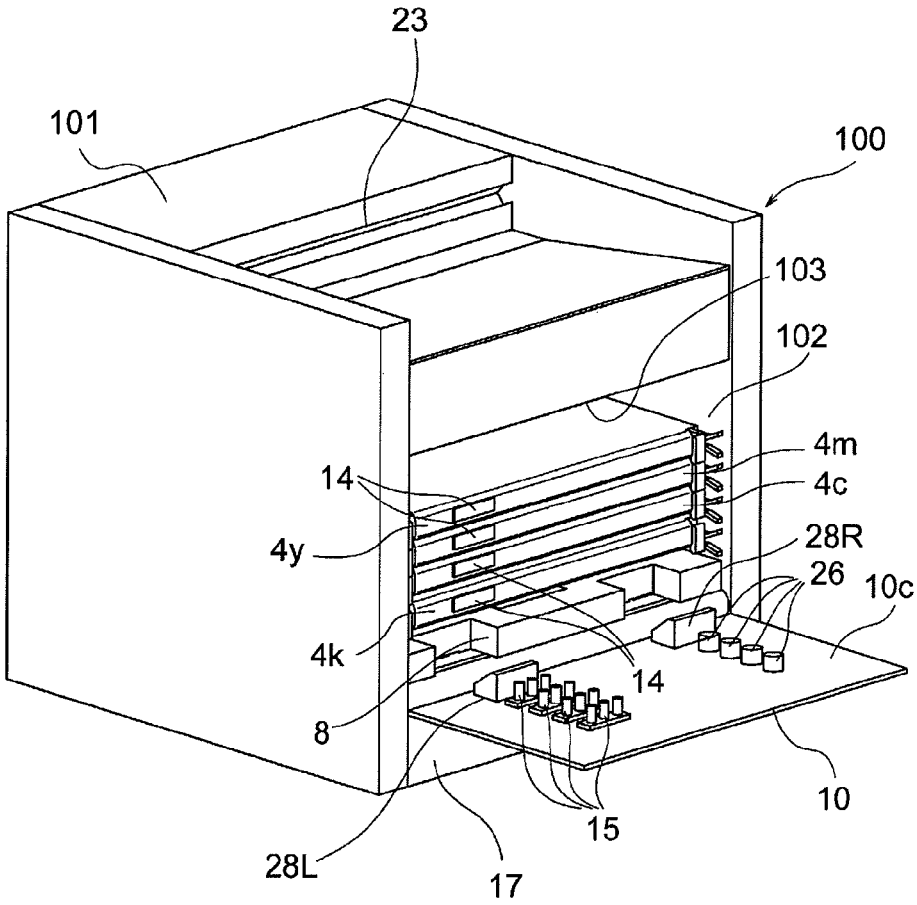
FIG. 2 is a perspective view of the image forming apparatus according to First Embodiment in a state in which a door is open.

At a front surface of the apparatus main assembly 101, an opening 103 is provided. The door 10 is rotationally moved about a hinge shaft 10*b* as the center in a door lower edge side, thus being capable of opening and closing the opening 103. By opening the door 10 by holding a handle 10*a* provided to the door 10, as shown in FIG. 2, the developing cartridge mounting and demounting portion 102 is opened.

As shown in FIG. 5, four sets of guide rails 25R and 25L extending in the horizontal direction are oppositely provided on inner wall surfaces of a right-side frame 105R and a left-side frame 105L of the apparatus main assembly 101. As shown in FIG. 6, portions to be guided 4Ra and 4La are provided at left-side surface portions and right-side surface portions of the developing cartridges 4*y*-4*k*, respectively. Projections to be guided 4Ra and 4La slide on the guide rails 25R and 25L in the horizontal direction (arrow X1 and X2 directions), so that the developing cartridges 4*y*-4*k* are detachably mountable to the developing cartridge mounting and demounting portion 102.

As shown in FIG. 5, on an inner surface 10*c* of the door 10 in the inside, positioning urging portions (contact portion) 26 are provided. The urging portions 26 urge the developing cartridges 4*y*-4*k* in a direction (arrow X2 direction) in which the cartridges are pushed in the developing cartridge mounting and demounting portion 102, thus positioning the developing cartridges 4*y*-4*k* in the apparatus main assembly 101.

(Exchange Type of Drum Cartridge 8)

As shown in FIG. 7, the drum cartridge 8 is demounted and mounted as described above in the state in which the portion 10 is opened and the developing cartridges 4*y*-4*k* are demounted. The drum cartridge 8 is guided, by left and right guide rails 27R and 27L provided on the bottom of the apparatus main assembly 101, in a demounting direction (X1 direction) or a mounting direction (X2 direction), thus being demounted from and mounted and the drum cartridge mounting and demounting portion 104.

(Drum Cartridge Mounting and Demounting Guide 28)

As shown in FIGS. 2, 5, 7 and 8, on the inner surface 10*c* of the door 10, drum cartridge mounting and demounting guides (mounting and demounting path regulating member) 28R and 28L are provided in left and right sides, respectively.

The drum cartridge mounting and demounting guides 28R and 29L are provided so that positions thereof are closer toward the door than a position of gravitation of the developing cartridges 4*y*-4*k* with respect to the demounting direction when the developing cartridges 4*y*-4*k* are located in the image forming apparatus main assembly. The mounting and demounting guides 28R and 28L are provided apart from each other with a distance not more than a width of the drum cartridge 8 with respect to the widthwise direction (arrow X4 direction).

The mounting and demounting guides 28R and 28L have an inclined surface 28*a* inclined upward with respect to a drum cartridge demounting direction (X1 direction) in the state in which the door 10 is open. Incidentally, as shown in FIG. 9, the inclined surface 28*a* may also be a curved surface if it is a gentle surface (slope). Further, the inclined surface 28*a* may also be constituted by an inclined surface and a curved surface. The mounting and demounting guides 28R and 28L have the same shape as seen from a left side surface direction as shown in (a) of FIG. 8 and are provided at the same position with respect to the demounting direction (X1 direction). For this reason, the drum cartridge 8 simultaneously contacts the mounting and demounting guides 28R and 28L. As a result, inclination of the drum cartridge 8 can be suppressed.

As shown in (a) of FIG. 8, the mounting and demounting guides 28R and 28L are, in the state in which the door 10 is open, provided closer to the inside of the apparatus main assembly than contact points (contact portions) 15 to be contacted to the contact points 14 (see FIG. 6) of the developing cartridges 4*y*-4*k* and than the urging portions 26. The developing cartridges 4*y*-4*k* are capable of being supplied with electric power from the apparatus main assembly via the contact points 14 and are operated by receiving electric signals. The contact points 15 and the urging portions 26 are projected from the door 10. Further, the mounting and demounting guides 28R and 28L are, when the door 10 is viewed from the left side surface direction, higher than the contact points 15 and the urging portions 26 (height in arrow X3 direction).

During the demounting of the drum cartridge 8 from the apparatus main assembly 101, when the drum cartridge 8 located at the drum cartridge mounting and demounting portion 104 is pulled out, a lower end of the drum cartridge 8 contacts the inclined surfaces 28*a* of the mounting and demounting guides 28R and 28L. Then, the drum cartridge 8 is moved along the inclined surfaces 28*a* in a direction in which it is moved away from the contact points 15 and the urging portions 26, so that the drum cartridge 8 is prevented from contacting the contact points 15 and the urging portions 26.

Thus, the mounting and demounting guides 28R and 28L regulate the drum cartridge 8 so as to pass along non-interference path (pass in which they do not interfere) with the contact points 15 and the urging portions 26. As a result, when the drum cartridge 8 is demounted from the downsized image forming apparatus 100, contact of the mounting and demounting guides 28R and 28L to the contact points 15 and the urging portions 26 is suppressed, so that damage and breakage of the contact points 15 and the urging portions 26 can be suppressed.

Incidentally, the mounting and demounting guides 28R and 28L are not limited to two but may also be one or three or more. Further, the width of the mounting and demounting guides 28R and 28L (width with respect to arrow X4 direction) is not particularly defined but is set at a width capable of maintaining a strength of not less than a certain level so that the mounting and demounting guides 28R and 28L are not broken even when they are contacted to the drum cartridge 8 when the drum cartridge 8 is demounted.

Incidentally, in this embodiment, the mounting and demounting guides 28R and 28L were described as members for regulating the drum cartridge 8. However, in the present invention, a member to be regulated by the mounting and demounting guides 28R and 28L is not limited to the drum cartridge 8 but may also be the cartridges, such as the developing cartridges 4*y*-4*k*, detachably mountable to the apparatus main assembly. That is, a constitution in which when the developing cartridges 4*y*-4*k* are demounted from the apparatus main assembly 101, the mounting and demounting guides 28R and 28L contact the developing cartridges 4*y*-4*k* or the like to suppress contact of the developing cartridges 4*y*-4*k* to the contact points 15 and the urging portions 26 may only be required.

As shown in FIGS. 10 and 11, the drum cartridge 8 includes a pulling-out member 8*c*, extending to a side close to the opening 103, provided with a handle 8*a* and left and right clearance portions 8Rd and 8Ld. The clearance portions 8Rd and 8Ld are provided by being formed in a shape such that they are recessed from an end portion of the drum cartridge 8 in the side close to the door 10. By providing the handle 8*a* at a surface in the side close to the opening 103, the drum cartridge 8 can be easily demounted.

A width of the clearance portions 8Rd and 8Ld with respect to the X4 direction is larger than a width of the mounting and demounting guides 28R and 28L with respect to the arrow X4 direction. Further, a width of the clearance portions 8Rd and 8Ld with respect to the X1 direction is larger than a height of the mounting and demounting guides 28R and 28L with respect to the arrow X3 direction. As a result, when the door 10 is closed, the mounting and demounting guides 28R and 28L can pass through the clearance portions 8Rd and 8Ld, so that the mounting and demounting guides 28R and 28L and the drum cartridge 8 are prevented from interfering with each other.

Second Embodiment

Next, Second Embodiment of an image forming apparatus according to the present invention will be described with reference to the drawings. Portions of redundancy in description with the above-described First Embodiment will be omitted from description by adding the same reference numerals or symbols. Part (a) of FIG. 12 is a side view of the door 10 according to this embodiment. Part (b) of FIG. 12 is a plan view of the door 10 according to this embodiment.

As shown in FIG. 12, in the image forming apparatus in this embodiment, in place of the drum cartridge mounting and demounting guides 28R and 28L of the image forming apparatus in the above-described First Embodiment, drum cartridge mounting and demounting guides 30R and 30L are provided. The mounting and demounting guides 30R and 30L are obtained by extending the mounting and demounting guides 28R and 28L in the pulling-out direction (arrow X1 direction). During the mounting and demounting of the drum cartridge 8, with respect to the pulling-out direction in which the drum cartridge 8 is demounted, first surface portions 30*b* of the mounting and demounting guides 30R and 30L have a length in which all of four contact points 15 and four urging portions 26 are covered.

The drum cartridge mounting and demounting guides 30R and 30L are provided outside the contact points 15 and the urging portions 26 with respect to the widthwise direction (arrow X4 direction) but may also be provided inside. The mounting and demounting guides 30R and 30L are provided apart from each other with a distance not more than a width of the drum cartridge 8 with respect to the widthwise direction (arrow X4 direction).

The mounting and demounting guides 30R and 30L have the same shape and are provided at the same position with respect to the demounting direction (X1 direction). For this reason, the drum cartridge 8 simultaneously contacts the mounting and demounting guides 30R and 30L. As a result, inclination of the drum cartridge 8 can be suppressed.

The mounting and demounting guides 30R and 30L have an inclined surface 30*a* inclined upward with respect to a drum cartridge demounting direction (X1 direction) in the state in which the door 10 is open. The mounting and demounting guides 30R and 30L are higher than the contact points 15 and the urging portions 26 with respect to the arrow X3 direction.

During the demounting of the drum cartridge 8 from the apparatus main assembly 101, when the drum cartridge 8 located at the drum cartridge mounting and demounting portion 104 is pulled out, a lower end of the drum cartridge 8 contacts the inclined surfaces 30*a* of the mounting and demounting guides 30R and 30L. Then, the drum cartridge 8 is moved upward (in a direction in which it is moved away from the inner surface 10*c* of the door 10) along the inclined surfaces 30*a* and is pulled out by being guided by flat surface portions 30*b*. For this reason, the drum cartridge 8 is prevented from contacting the contact points 15 and the urging portions 26.

As a result, similarly as in the above-described First Embodiment, when the drum cartridge 8 is demounted from the downsized image forming apparatus 100, contact of the mounting and demounting guides 28R and 28L to the contact points 15 and the urging portions 26 is suppressed, so that damage and breakage of the contact points 15 and the urging portions 26 can be suppressed.

Further, by providing the flat surface portions 30*b*, the drum cartridge 8 can be further stably mounted and demounted, so that a possibility that the drum cartridge 8 runs against the contact points 15 and the urging portions 26 can be further reduced.

As shown in FIG. 13, the drum cartridge 8 is changed in constitution from the clearance portions in the above-described First Embodiment. The clearance portions 8Re and 8Le are constituted so that the mounting and demounting guides 30R and 30L can pass through the clearance portions 8Rd and 8Ld when the door 10 is closed, so that the mounting and demounting guides 30R and 30L and the drum cartridge 8 are prevented from interfering with each other.

As shown in FIG. 14, the developing cartridges 4*y*-4*k* in this embodiment includes the clearance portions 4Rb and 4Lb at an outer surface of the apparatus main assembly in a state in which they are mounted in the apparatus main assembly. The clearance portions 4Rb and 4Lb are constituted so that the mounting and demounting guides 30R and 30L passes through the clearance portions 4Rb and 4Lb when the door 10 is closed to prevent the mounting and demounting guides 30R and 30L and the developing cartridges 4*y*-4*k* from interfering with each other.

Third Embodiment

Next, Third Embodiment of an image forming apparatus according to the present invention will be described with reference to the drawings. Portions of redundancy in description with the above-described First or Second Embodiment will be omitted from description by adding the same reference numerals or symbols. Part (a) of FIG. 15 is a side view of the drum cartridge 8 according to this embodiment. Part (b) of FIG. 15 is a plan view of the drum cartridge 10 according to this embodiment.

(Drum Cartridge Leg Portions 8Rf and 8Lf)

As shown in FIG. 15, in the image forming apparatus in this embodiment, the position where the drum cartridge mounting and demounting guides 28R and 28L are provided is changed from the door inner surface 10*c* to a drum cartridge lower surface 8*e* and the mounting and demounting guides 28R and 28L are changed to drum cartridge positions 8Rf and 8Lf. The drum cartridge leg portions 8Rf and 8Lf are provided in a side close to the door 10 when the drum cartridge 8 is mounted in the apparatus main assembly 101. Incidentally, in this embodiment, in (a) of FIG. 15, the positions 8Rf and 8Lf are provided at a position which coincides with an end portion of the demounting direction (X1 direction) of the drum cartridge 8 but may also be provided at different positions if the positions are a position where the inclination of the drum cartridge 8 can be prevented when the drum cartridge 8 is pulled out from the apparatus main assembly 101.

A height of the drum cartridge leg portions 8Rf and 8Lf with respect to the X3 direction is made large compared with the contact points 15 and the urging portions 26 so that the drum cartridge leg portions 8Rf and 8Lf do not contact the contact points 15 and the positioning urging portions 26 on the door when the drum cartridge 8 is inclined and is supported by the drum cartridge leg portions 8Rf and 8Lf.

When the drum cartridge leg portions 8Rf and 8Lf are mounted in the apparatus main assembly 101, leg portion lower surfaces 8Rg and 8Lg contacting the door inner surface 10*c* are flat surfaces parallel to the bottom surface 8*e* of the drum cartridge 8. Incidentally, when the drum cartridge 8 is pulled out from the apparatus main assembly 101, if the drum cartridge 8 can be supported without being inclined, the leg portion lower surfaces 8Rg and 8Lg are not required to be the flat surfaces parallel to the bottom surface 8*e* but may also be, e.g., curved surfaces.

As shown in (b) of FIG. 15, a distance between the drum cartridge leg portions 8Rf and 8Lf is larger than a width of the hinge shaft 10*b* of the door 10 with respect to the X4 direction. Incidentally, in this embodiment, the leg portions 8Rf and 8Lf are two but may also be one, or three or more if they have a structure in which they do not contact the hinge shaft 10*b* of the door 10 when the drum cartridge 8 is demounted from the apparatus main assembly 101. Further, the hinge shaft of the door 10 may also be two or more.

The drum cartridge leg portion 8Rf is, when the drum cartridge 8 is viewed from the front direction, provided in the right side of the position of the positioning urging portions 26 and is provided so that its right end coincides with the right end of the drum cartridge 8. Further, a width of the leg portion 8Rf with respect to the X4 direction is not particularly defined but is a width with which the leg portion 8Rf can have a strength at a certain level or more capable of supporting the drum cartridge 8 when the drum cartridge 8 is inclined.

Incidentally, the right end of the leg portion 8Rf coincides with the right end of the drum cartridge 8 but may also not coincide with the right end of the drum cartridge 8 if the drum cartridge 8 can be supported without being inclined. Further, in this embodiment, when the drum cartridge 8 is mounted in the apparatus main assembly 101, the position 8Rf is disposed in the right side of the urging portions 26 but may also be disposed in the left side of the urging portions 26 if the drum cartridge 8 can be supported without being inclined.

The drum cartridge leg portion 8Lf is, when the drum cartridge 8 is viewed from the front direction, provided in the left side of the position of the contact points 15 and is provided so that its left end coincides with the left end of the drum cartridge 8. Further, a width of the leg portion 8Lf with respect to the X4 direction is not particularly defined but is a width with which the leg portion 8Lf can have a strength at a certain level or more capable of supporting the drum cartridge 8 when the drum cartridge 8 is inclined.

Incidentally, the left end of the leg portion 8Lf coincides with the left end of the drum cartridge 8 but may also not coincide with the right end of the drum cartridge 8 if the drum cartridge 8 can be supported without being inclined. Further, in this embodiment, when the drum cartridge 8 is mounted in the apparatus main assembly 101, the position 8Lf is disposed in the left side of the contact points 15 but may also be disposed in the right side of the contact points 15 if the drum cartridge 8 can be supported without being inclined.

The drum cartridge 8 is, immediately before and after being demounted from the apparatus main assembly 101, supported in contact to the apparatus main assembly 101 at its lower surface 8*e* but when it is demounted to some extent, the center of gravity of the drum cartridge is moved relative to the image forming apparatus main assembly and the drum cartridge 8 is inclined by its own weight and therefore, a part of the lower surface 8*e* contacts the apparatus main assembly 101 and the drum cartridge leg portion lower surfaces 8Rg and 8Lg contact the door inner surface 10*c*, so that the drum cartridge 8 is supported. At this time, as described above, the height of the drum cartridge leg portions 8Rf and 8Lf with respect to the X3 direction is large compared with the contact points 15 and the positioning urging portions 26 and therefore when the drum cartridge 8 is demounted from the apparatus main assembly 101, it is possible to avoid contact of the main assembly of the drum cartridge 8 to the contact points 15 and the positioning urging portions 26.

Incidentally, as shown in (a) of FIG. 15, the drum cartridge leg portions 8Rf and 8Lf are provided in a pair at the end portion of the lower surface 8*e* with respect to the demounting direction (X1 direction) but may be further provided in a pair also at the end portion with respect to the mounting direction (X2 direction) as shown in (a) of FIG. 17. By this constitution, during the demounting of the drum cartridge 8 from the apparatus main assembly 101, when the drum cartridge 8 is demounted to some extent or more, the leg portions 8Rf and 8Lf at the end portion with respect to the demounting direction (X1 direction) are separated from the door surface 11*c* and therefore cannot support the drum cartridge 8 but the positions 8Rf and 8Lf at the end portion with respect to the mounting direction (X2 direction) can support the drum cartridge 8 and therefore, it is possible to further avoid the contact of the drum cartridge 8 to the contact points 15 and the urging portions 26.

Further, a width of the drum cartridge leg portions 8Rf and 8Lf with respect to the X1 direction is not particularly defined if the drum cartridge 8 can be supported without being inclined, but as shown in (b) of FIG. 17, the leg portions 8Rf and 8Lf are extended from the end portion with respect to the demounting direction (X1 direction) to the end portion with respect to the mounting direction (X2 direction), so that similarly as in the above-described constitution, it is possible to more avoid the contact of the drum cartridge 8 to the contact points 15 and the urging portions 26.

Incidentally, a member defined by the drum cartridge leg portions 8Rf and 8Lf shown in this embodiment is not limited to the drum cartridge 8 as in this embodiment but may also be another cartridge such as the developing cartridges or the like if the cartridge is detachably mountable to the apparatus main assembly 101.

(Constitution Example of Portion)

In this embodiment, shapes of the door 10 and the door 10*b* are partly changed.

As shown in FIG. 16, the hinge shaft 10*b* of the door 10 is disposed at the central portion of the door 10 with respect to the X4 direction, so that the door 10 is openable with respect to the apparatus main assembly 101. Incidentally, in this embodiment, the hinge shaft 10*b* is one but may also be disposed at a position other than the central portion and may also be two or more if it has a structure which does not interfere with the drum cartridge leg portions 8Rf and 8Lf.

Fourth Embodiment

Next, Fourth Embodiment of an image forming apparatus according to the present invention will be described with reference to the drawings. Portions of redundancy in description with the above-described First to Third Embodiments will be omitted from description by adding the same reference numerals or symbols. Part (a) of FIG. 18 is a perspective view of the image forming apparatus according to this embodiment. Part (b) of FIG. 18 is an illustration of the image forming apparatus according to this embodiment.

As shown in FIG. 18, the image forming apparatus in this embodiment includes an all-in-one cartridge (process cartridge) including a positioning device and a drum. As shown in FIG. 18, the all-in-one cartridge 9 is detachably mounted to an all-in-one cartridge mounting and demounting portion 106 of an image forming apparatus main assembly 101 in a state in which a door 10 is open.

The all-in-one cartridge 9 includes a photosensitive drum 1. The photosensitive drum 1 is electrically charged by a charger 2 at its drum surface and is exposed to laser light L on the basis of image information by an exposure device 3, so that an electrostatic latent image is formed. The electrostatic latent image is developed, with a toner of black, as a toner image of each color a developing roller 4*a*.

On the other hand, a sheet S stacked in a feeding cassette 17 is conveyed to a nip between a transfer roller 32 and the photosensitive drum 1 by a feeding roller 18 and a registration roller pair 19, so that the toner image transferred on the photosensitive drum 1 is transferred. The sheet S on which the toner image is transferred is subjected to fixing of the toner image by a fixing portion 20 and is discharged to the outside of the apparatus main assembly by a discharging roller pair 23. A transfer residual toner remaining on the photosensitive drum 1 is cleaned (removed) by a drum cleaning device 6.

(Exchange Type of all-in-One Cartridge 9)

By opening the door 10 by holding a handle 10*a* provided to the door 10, an opening 103 is opened and as shown in FIG. 19, the all-in-one cartridge mounting and demounting portion 106 is opened.

As shown in FIG. 20, the all-in-one cartridge 9 is mounted and demounted in the state in which the door 10 is open as described above. The all-in-one cartridge 9 is guided by left and right guide rails 27R and 27L provided on the bottom of the apparatus main assembly 101 with respect to a demounting direction (X1 direction) or a mounting direction, thus being mounted to end demounted from the all-in-one cartridge mounting and demounting portion 106.

As shown in FIG. 21, on an inner surface 10*c* of the door 10, positioning urging portions (contact portion) 26 are provided. The urging portions 26 urge the all-in-one cartridge 9 in a direction (arrow X2 direction) in which the all-in-one cartridge 9 is pushed in the all-in-one cartridge mounting and demounting portion 106, thus positioning the developing cartridges 4*y*-4*k* in the apparatus main assembly 101.

(Exchange Type of Drum Cartridge 8)

As shown in FIG. 7, the drum cartridge 8 is demounted and mounted as described above in the state in which the portion 10 is opened and the developing cartridges 4*y*-4*k* are demounted. The drum cartridge 8 is guided, by left and right guide rails 27R and 27L provided on the bottom of the apparatus main assembly 101, in a demounting direction (X1 direction) or a mounting direction (X2 direction), thus being demounted from and mounted and the drum cartridge mounting and demounting portion 104.

(All-in-One Cartridge Mounting and Demounting Guide 28)

As shown in FIGS. 19, 21 and 22, on the inner surface 10*c* of the door 10, all-in-one cartridge mounting and demounting guides (mounting and demounting path regulating member) 28R and 28L are provided in left and right sides, respectively. The all-in-one cartridge mounting and demounting guides 28R and 28L change the object to be guided from the drum cartridge 8 in the above-described First Embodiment to the all-in-one cartridge 9 but the constitution thereof is the same as that of the drum cartridge mounting and demounting guides 28R and 28L. Incidentally, also with respect to an object of the effect in this embodiment, the object is changed from the drum cartridge 8 to the all-in-one cartridge 9 but the contents of the effect are the same as those in First Embodiment.

As shown in FIG. 23, the all-in-one cartridge 9 includes a pulling-out member 9*a*, extending to a side close to the opening 103, provided with a handle 9*b* and left and right clearance portions 9Rd and 9Ld. By providing the handle 9*b* at a surface in the side close to the opening 103, the all-in-one cartridge 9 can be easily demounted. Further, a width of the clearance portions 9Rd and 9Ld with respect to the X4 direction is larger than a width of the mounting and demounting guides 28R and 28L with respect to the arrow X4 direction. Further, a width of the clearance portions 9Rd and 9Ld with respect to the X1 direction is larger than a height of the mounting and demounting guides 28R and 28L with respect to the arrow X3 direction. As a result, when the door 10 is closed, the mounting and demounting guides 28R and 28L can pass through the clearance portions 9Rd and 9Ld, so that the mounting and demounting guides 28R and 28L and the all-in-one cartridge 9 are prevented from interfering with each other.

Fifth Embodiment

Next, Fifth Embodiment of an image forming apparatus according to the present invention will be described with reference to the drawings. Portions of redundancy in description with the above-described First to Fourth Embodiments will be omitted from description by adding the same reference numerals or symbols.

As shown in FIG. 24, in the image forming apparatus in this embodiment, in place of the all-in-one cartridge mounting and demounting guides 28R and 28L of the image forming apparatus in the above-described Fourth Embodiment, all-in-one cartridge mounting and demounting guides 30R and 30L are provided. Further, the all-in-one cartridge mounting and demounting guides 30R and 30L change the object to be guided from the drum cartridge 8 in the above-described Second Embodiment to the all-in-one cartridge 9 but the constitution thereof is the same as that of the drum cartridge mounting and demounting guides 28R and 28L. Incidentally, also with respect to an object of the effect in this embodiment, the object is changed from the drum cartridge 8 to the all-in-one cartridge 9 but the contents of the effect are the same as those in Second Embodiment.

As shown in FIG. 25, the all-in-one cartridge 9 changes the constitution from the clearance portions in the above-described Fourth Embodiment. The clearance portions 9Re and 9Le are constituted so that the mounting and demounting guides 30R and 30L can pass through the clearance portions 9Re and 9Le when the door 10 is closed, so that the mounting and demounting guides 30R and 30L and the all-in-one cartridge 9 are prevented from interfering with each other.

Sixth Embodiment

Next, a Sixth Embodiment of an image forming apparatus according to the present invention will be described with reference to the drawings. Portions of redundancy in the description with the above-described First to Fifth Embodiments will be omitted from the description by adding the same reference numerals or symbols. Part (a) of FIG. 26 is a side view of the all-in-one cartridge 9 according to this embodiment. Part (b) of FIG. 26 is a front view of the all-in-one cartridge 9 according to this embodiment.

(All-in-one cartridge leg portions 9Rf and 9Lf)

As shown in FIG. 25, in the image forming apparatus in this embodiment, the position where the all-in-one cartridge mounting and demounting guides 30R and 30L are provided is changed from the door inner surface 10*c* to a all-in-one cartridge lower surface 9*e* and the mounting and demounting guides 30R and 30L are changed to drum cartridge leg portions 9Rf and 9Lf. Further, the object to be guided from the drum cartridge 8 in the above-described Third Embodiment to the all-in-one cartridge 9 but the constitution thereof is the same as that of the drum cartridge leg portions 8Rf and 8Lf. Incidentally, also with respect to an object of the effect in this embodiment, the object is changed from the drum cartridge 8 to the all-in-one cartridge 9 but the contents of the effect are the same as those in Third Embodiment.

As described above, by the constitutions of the above-described Embodiments 1 to 6, even when a path along which the cartridge is demounted from the apparatus main assembly is narrowed with downsizing of the image forming apparatus, a user can easily demount the cartridge from the apparatus main assembly without breaking the urging portions and the contact points on the door.

INDUSTRIAL APPLICABILITY

As described above, according to the present invention, there is provided the image forming apparatus capable of suppressing the contact of the cartridge to the positioning urging portions of the door when the cartridge is demounted from the downsized image forming apparatus and thus capable of suppressing the damage and breakage of the positioning urging portions.

The invention claimed is:

1. An image forming apparatus for forming an image on a recording material, comprising:

a drum cartridge including a photosensitive drum and being detachably mountable to a main assembly of said image forming apparatus;

a plurality of developing cartridges each including a developing roller and each being detachably mountable to the main assembly of said image forming apparatus;

a door for opening and closing an opening through which each of said drum cartridge and said plurality of developing cartridges are accommodated in the main assembly;

a door-side contact portion provided on said door, wherein said door-side contact portion is projected upward when said door is open and is contactable to a cartridge-side contact portion provided on any one of said drum cartridge and said plurality of developing cartridges when said door is closed; and a path regulating member provided on a mounting and demounting path of said drum cartridge and provided upstream of said door-side contact portion with respect to a demounting direction of said drum cartridge, wherein said path regulating member is projected upward, wherein when said drum cartridge is demounted from the main assembly, said drum cartridge contacts said path regulating member to be moved upward, wherein said drum cartridge includes a clearance portion, and wherein said path regulating member enters the clearance portion in a state in which said drum cartridge is mounted in the main assembly.

2. An image forming apparatus according to claim 1, wherein the clearance portion is a cut-away portion provided in said drum cartridge.

3. An image forming apparatus according to claim 1, wherein said door-side contact portion is an urging portion for urging said cartridge by applying a force to said cartridge-side contact portion.

4. An image forming apparatus according to claim 1, wherein said door-side contact portion is an electrical contact for being electrically contacted with said cartridge-side contact portion.

5. An image forming apparatus according to claim 4, wherein said door-side contact portion and said cartridge-side contact portion are electrical contacts for establishing communication of an electric signal.

6. An image forming apparatus according to claim 1, wherein said path regulating member has an inclined surface, and wherein a bottom of said drum cartridge is moved upward along the inclined surface.

7. An image forming apparatus according to claim 1, wherein said drum cartridge and said developing cartridges are arranged in a vertical direction, and wherein said drum cartridge is located in an undermost position of said drum cartridge and said developing cartridges.

8. An image forming apparatus according to claim 1, wherein when said drum cartridge is demounted from the main assembly, all of said developing cartridges are required to be demounted from the main assembly before demounting said drum cartridge.

9. An image forming apparatus according to claim 1, wherein said door-side contact portion is provided in a plurality of door-side contact portions contactable to said drum cartridge and said developing cartridges, respectively.

10. An image forming apparatus according to claim 1, wherein said drum cartridge includes a handle for being gripped by a user when said drum cartridge is demounted.

11. An image forming apparatus according to claim 10, wherein with respect to a longitudinal direction of said photosensitive drum, said path regulating member is positioned outside said handle.

12. An image forming apparatus according to claim 1, wherein when said drum cartridge is demounted from the main assembly, a bottom of said drum cartridge passes over said door-side contact portion by contact of said drum cartridge with said path regulating member.

* * * * *